US011851260B2

(12) United States Patent
Wetsch

(10) Patent No.: US 11,851,260 B2
(45) Date of Patent: Dec. 26, 2023

(54) AUTOMATIC PROTECTIVE PACKAGING INFLATOR

(71) Applicant: PREGIS INNOVATIVE PACKAGING LLC, Deerfield, IL (US)

(72) Inventor: Thomas D. Wetsch, St. Charles, IL (US)

(73) Assignee: Pregis Innovative Packaging LLC, Chicago, IL (US)

( * ) Notice: Subject to any disclaimer, the term of this patent is extended or adjusted under 35 U.S.C. 154(b) by 904 days.

(21) Appl. No.: 16/518,705

(22) Filed: Jul. 22, 2019

(65) Prior Publication Data

US 2020/0024059 A1 Jan. 23, 2020

Related U.S. Application Data

(60) Provisional application No. 62/775,216, filed on Dec. 4, 2018, provisional application No. 62/702,175, filed on Jul. 23, 2018.

(51) Int. Cl.
*B65D 81/05* (2006.01)
*B31D 5/00* (2017.01)

(52) U.S. Cl.
CPC ..... *B65D 81/052* (2013.01); *B31D 5/0073* (2013.01); *B31D 2205/0035* (2013.01); *B31D 2205/0058* (2013.01); *B31D 2205/0088* (2013.01)

(58) Field of Classification Search
CPC ..... B65D 81/052; B31D 5/0073; B31D 2205/035; B31D 2205/0058
USPC ..... 53/79; 425/35.2; 428/166
See application file for complete search history.

(56) References Cited

U.S. PATENT DOCUMENTS 4,705,085 A * 11/1987 Brown ..... B65D 81/3881 206/522
4,918,904 A * 4/1990 Pharo ..... B65D 81/03 493/931
5,042,663 A * 8/1991 Heinrich ..... B65D 81/052 206/522
5,261,466 A * 11/1993 Koyanagi ..... B65B 3/04 141/10
5,482,492 A * 1/1996 Becker ..... A63H 27/10 383/44
5,824,392 A * 10/1998 Gotoh ..... B29C 49/0047 428/178

(Continued)

*Primary Examiner* — Robert F Long
*Assistant Examiner* — Xavier A Madison
(74) *Attorney, Agent, or Firm* — Fox Rothschild LLP

(57) ABSTRACT

An inflatable protective packaging unit and associated inflation systems are disclosed. The unit can include an inflatable component that includes overlaid flexible plies connected to each other to define a fluid chamber therebetween. The inflatable component can define an inflation region in fluid communication with the fluid chamber to allow fluid from the inflation region into the fluid chamber. The unit can further include a receiver separably attached to the inflatable component at the inflation region and configured to direct fluid into the inflation region. The inflation system can be configured to discretely engage the inflatable protective packaging unit and provide fluid for inflation. Once inflated, the system may eject the unit, and cause the inflatable component to separate from the receiver.

24 Claims, 23 Drawing Sheets

(56) References Cited

U.S. PATENT DOCUMENTS 5,901,850 A * 5/1999 Jones ..... B65D 81/052 383/3
6,283,296 B1 * 9/2001 Newman ..... B65D 81/052 206/522
6,913,803 B2 * 7/2005 Peper ..... B32B 21/08 206/522
7,297,387 B2 * 11/2007 Koyanagi ..... B31D 5/0073 428/166
7,992,601 B2 * 8/2011 Liao ..... F16K 15/147 141/313
8,424,552 B2 * 4/2013 Wetsch ..... B31D 5/0073 137/14
8,590,574 B2 * 11/2013 Jian ..... B65D 81/052 137/846
8,978,693 B2 * 3/2015 Frayne ..... F16K 15/147 137/512
9,517,874 B2 * 12/2016 Koyanagi ..... B65D 85/07
2003/0108699 A1 * 6/2003 Tanaka ..... B65D 81/052 428/35.2
2004/0163991 A1 8/2004 Koyanagi
2005/0109656 A1 5/2005 Ishizaki
2007/0056647 A1 * 3/2007 Frayne ..... B65D 31/145 137/843
2008/0029162 A1 * 2/2008 Wetsch ..... B31D 5/0073 137/223
2008/0250753 A1 * 10/2008 Sperry ..... B29C 66/0044 53/79
2011/0233101 A1 * 9/2011 Baines ..... B31D 5/0073 206/522
2015/0291336 A1 * 10/2015 Wetsch ..... B32B 3/30 428/43
2018/0297729 A1 * 10/2018 Liao ..... B65D 81/03
2019/0225406 A1 * 7/2019 Kim ..... B32B 5/024

* cited by examiner

AUTOMATIC PROTECTIVE PACKAGING INFLATOR

CROSS-REFERENCE TO RELATED APPLICATIONS

This patent application is a non-provisional patent application of, and claims priority to, U.S. Provisional Application No. 62/702,175 filed Jul. 23, 2018, and titled "PACKAGING INFLATION SYSTEM", and to U.S. Provisional Application No. 62/775,216 filed Dec. 4, 2018, and titled "AUTOMATIC PROTECTIVE PACKAGING INFLATOR", each of which is hereby incorporated by reference in its entirety.

FIELD

The described embodiments relate generally to packaging materials. More particularly, the present embodiments relate to systems and devices for processing inflatable protective packaging units to be used as packaging materials.

BACKGROUND

Products and packages may be produced and/or shipped in a variety of containers and configurations for transportation and sale. In order to protect the packages from being crushed or damaged during transportation, producers may use various combinations of packaging materials to form a protective outer layer over the products and otherwise maintain the form factor of the product within the package. Many traditional systems for producing packaging material suffer from significant drawbacks that may affect the adaptability of the system to process inflatable packaging materials, such as processing inflatable packaging materials in rapid succession. As such, the need continues for improved approaches to facilitate inflatable packaging material production.

SUMMARY

Embodiments of the present invention are directed to components and systems associated with an automatic protective packaging inflator.

In an embodiment, an inflatable protective packaging unit is disclosed. The packaging unit includes an inflatable component that includes overlaid flexible plies connected to each other to define a fluid chamber therebetween. The inflatable component can define an inflation region in fluid communication with the fluid chamber to allow fluid from the inflation region into the fluid chamber. The packaging unit can further include a receiver separably attached to the inflatable component at the inflation region and configured to direct fluid into the inflation region.

In another embodiment, the receiver can be disposed between the flexible plies. The receiver can be separably attached to the inflatable component by a frangible connection. The frangible connection can be defined by a spot weld between the receiver and one or more of the flexible plies.

In another embodiment, the receiver can be separably attached to the inflatable component by a loose connection. In some cases, air-permeable gaps can be defined between the receiver and the flexible plies.

In another embodiment, the receiver can be separably attached to the inflatable component by a friction fit.

In another embodiment, the inflatable component can include a valve configured to allow one-way fluid flow from the inflatable component into the fluid chamber. The valve can include opposing flaps defining therebetween a collapsible fluid passage that opens in response to increased pressure in the inflation region to allow fluid flow into the fluid chamber. The valve can collapse upon increased pressure in the fluid chamber to retain the fluid therein.

In another embodiment, flexible plies can define a group of fluid chambers in fluid communication with the inflation region, each of fluid chambers being fluidly isolated from one another.

In another embodiment, the inflatable protective packaging unit of claim 1, wherein the receiver has a rigidity that is greater than a rigidity of the inflatable component. The receiver can define an exterior facing entry opening to receive the fluid. The receiver can have sufficient rigidity to maintain open the entry opening. The receiver can be configured to receive an inflation component of an inflation device into the entry opening to thereby receive the fluid and direct the fluid into the inflation region.

In another embodiment, the receiver can include a body defining a channel therethrough that leads to the inflation region. The body can be sufficiently rigid to suspend the flexible plies. The receiver can be separable from the inflation component upon pulling the inflatable component axially with respect to the channel of the receiver.

In another embodiment, the packaging unit further includes a frangible connection between the receiver and the inflation component that is sufficiently strong enough to suspend the flexible plies from the body. The receiver can include a protrusion extending laterally with respect to the channel and configured to engage a track of an inflation device suitable to support the inflatable protective packaging unit therefrom. The protrusion can extend radially about the channel of the receiver and is configured to be received in a gap between opposite side of the track and supported by the opposite sides of the track.

In another embodiment, an inflation system. The system includes an inflatable protective packaging unit, such as any of the inflatable protective packaging units described herein. The system further includes an inflatable protective packaging unit support magazine configured to receive the inflatable protective packaging unit and another inflatable protective packaging unit.

In another embodiment, the system can further include an inflator that is guided into the receiver at a filling station and configured to deliver fluid into the receiver for filling the fluid chamber. In some cases, the system can further include an advancement mechanism configured to advance the inflatable protective packaging unit from a first position in the magazine to the filling station. Additionally or alternatively, the system can further include a separator disposed and configured to separate the receiver from the inflatable component after the inflatable component has been inflated with the fluid.

In another embodiment, the separator can be disposed at a separation station. This regard, the system can further include an inflator drive that drives the inflator from the filling station to the separation station such that the inflator thereby moves the receiver to the separator to cause the separation of the receiver from the inflatable component. In some cases, the separator can move the inflation component axially away from the receiver as the receiver is moved along a diverging element.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings in which.

Figure 1A:
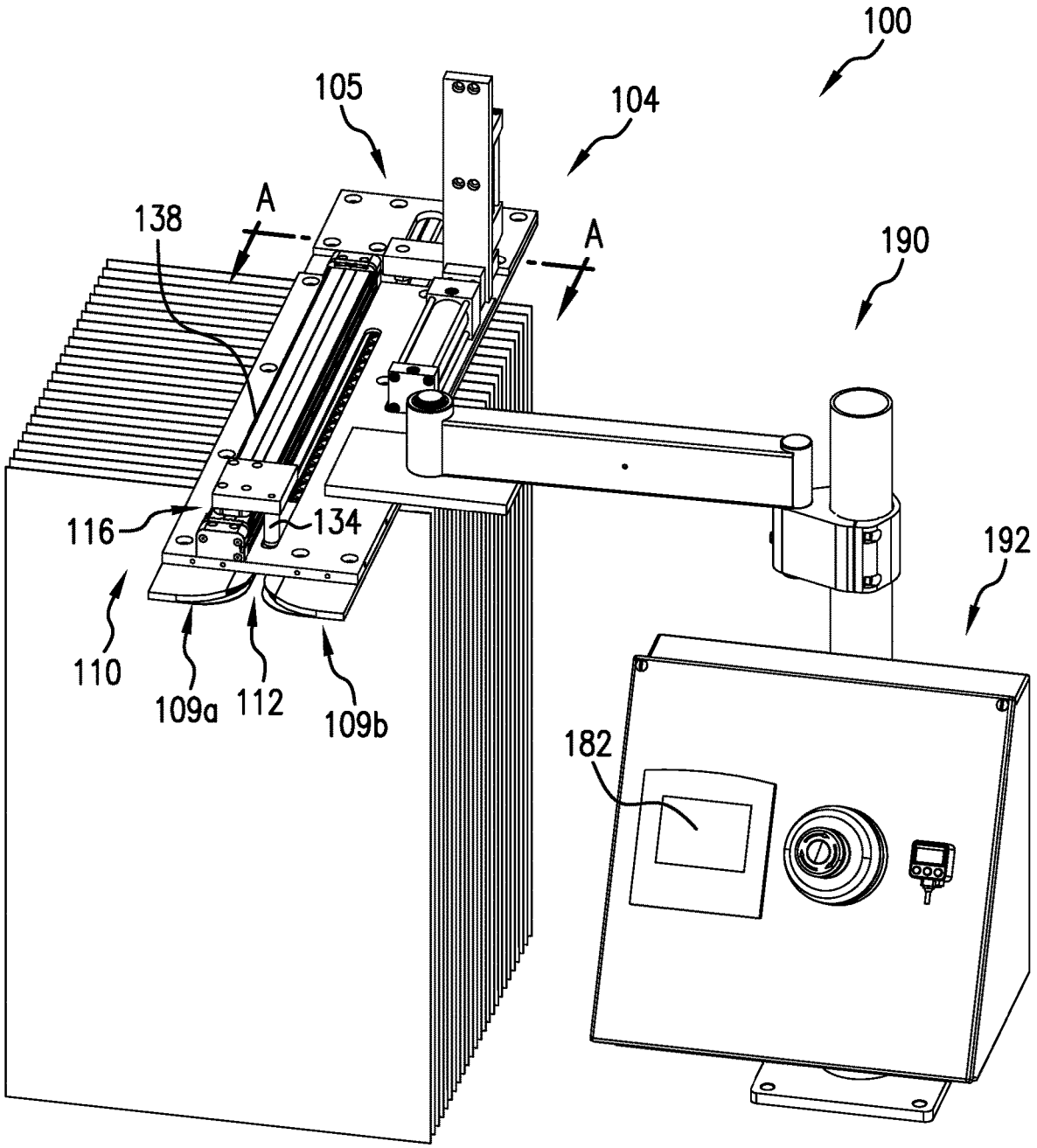
FIG. 1A depicts a perspective view of an inflation system.

The use of cross-hatching or shading in the accompanying figures is generally provided to clarify the boundaries between adjacent elements and to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

The following disclosure describes systems, devices, and techniques related to packaging systems that are used to produce inflatable packaging materials. The packaging system may include an inflation device that is configured to receive inflatable packaging materials, such as a group of inflatable protective packaging units, in an uninflated configuration. In the uninflated configuration, the inflatable packaging material may be stored and advanced toward a filling position, where the inflation device may operate to discretely provide fluid to the inflatable packaging materials. Once inflated, the inflation device may discretely eject the inflatable packaging material, such as into a bin or other components or systems where a producer may access the inflated packaging material. The inflation system may facilitate rapid, sequential inflation of inflatable packaging material, thereby allowing producers to access a continuous or substantially continuous supply of inflated packaging materials for packaging products or other appropriate uses.

As used here, "inflatable packaging materials" may generally refer to packaging materials having an inflatable fluid chamber. The inflatable fluid chamber may be defined by flexible walls that increase in volume or expand when the chamber is filled with a fluid, including air, nitrogen, and/or other appropriate fluids. When filled, the chamber may retain at least some of the fluid and be used to form a protective barrier around a product or other item. The inflatable packaging materials may therefore be constructed in a variety of sizes, shapes, weights, and other characteristics that are adapted to provide the desired protective characteristics.

As described in greater detail below, inflatable packaging materials, such as an inflatable protective packaging unit, may include, or be defined by, various suitable inflatable structures such as cushions, bags, or the like. The inflatable protective packaging unit may include multiple plies that define one or more fluid chambers. The plies may be flexible so that the fluid chambers are inflated when fluid is introduced via an inflation region. In the case of multiple fluid chambers, the plies may also define the inflation region that is configured to direct fluid from an opening in the inflatable protective packaging unit to each of the fluid chambers. In some embodiments, this may be an open channel. In other embodiments, this may be a closed channel. Multiple channels can come together to form an inflation region. The fluid chambers may be fluidly isolated from one another and configured to prevent fluid escape into the inflation region. This may allow each of the fluid chambers to define distinct inflatable segments of the inflatable protective packaging unit that are moveable with respect to one another, thereby allowing for adaptive positioning around a target product or other item for protecting.

In accordance with various embodiments, the inflatable protective packaging unit includes an inflation component receiver. The inflation component receiver may generally define a fluid path between an inflation component and one or more internal volumes of the inflatable protective packaging unit, such as one or more fluid chambers, manifolds, and so on. For example, the inflation component receiver may be positioned at least partially within an opening defined by the flexible plies of the inflatable protective packaging unit and direct fluid from a fluid source into the internal volume(s) of the inflatable protective packaging unit.

The inflation component receiver may also be used to facilitate coupling the inflatable protective packaging unit with the inflation device. For example, the flexible plies of the inflatable protective packaging unit may be suspended from the inflation component receiver, and the inflation component receiver may be received by the inflation device. To facilitate the foregoing, the inflation component receiver may include a protrusion or other engagement feature that is received by the inflation device in a manner suitable to support the inflatable protective packaging unit within the device. In some cases, the inflation component receiver may be separably attached to the flexible plies. For example, flexible plies may be suspended from the inflation component receiver in part by a friction fit, frangible connection, and/or other feature that allows the inflation component receiver to be separated from the flexible plies without substantially damaging the flexible plies.

In certain embodiments, the inflation device may detach the flexible plies from the inflation component receiver, for example, after inflation of the fluid chamber(s) of the inflatable protective packaging unit. In this regard, the inflation component receiver may be discarded or recycled rather than used as protective packing. This may be beneficial, for example, when the inflation component receiver is formed from a different, more rigid material than the flexible plies.

The inflatable protective packaging units can be inflated using the inflation device as further discussed herein. A group of inflatable protective packaging units may be provided to the inflation device in an uninflated configuration. An inflatable protective packaging unit support mechanism may define a magazine that receives the group of inflatable protective packaging units and stores the cushions for subsequent inflation by the inflation device. For example, the inflatable protective packaging unit support mechanism may define a track that is configured to receive the inflation component receiver (or other feature of the inflatable protective packaging unit) in a manner that allows the inflatable protective packaging unit to be suspended or otherwise supported by the inflatable protective packaging unit support mechanism.

The track, which may be a through portion of the inflatable protective packaging unit support mechanism defined by opposing wall portions, may define a path along which one or more of the inflatable protective packaging units may be discretely moved. The group of inflatable protective packaging units may be discretely moved toward, for example, a filling position (for inflation), a separator (for detachment of inflation component receiver and respective plies), a device exit, and/or other operation of the inflation device. The inflatable protective packaging unit support mechanism therefore may allow inflatable protective packaging units to be sequentially processed, which may facilitate rapid cushion inflation and deployment in packaging-related activities, as described herein.

Sequential processing, or other movement of the inflatable components, may be accomplished by an advancement mechanism of the inflation device. The advancement mechanism may be arranged relative to the track that is defined by the inflatable protective packaging unit support mechanism and engage one or more inflatable protective packaging units supported thereon. To facilitate the foregoing, in one embodiment, the advancement mechanism may include a pusher that at least partially extends into the track. The pusher may couple with an inflatable protective packaging unit supported in the track and bias the inflatable protective packaging unit along the path formed by the track. Where multiple inflatable protective packaging units are supported by the track, the pusher may couple with any given one of the inflatable protective packaging units, and cause the group of inflatable protective packaging units to be biased along the path. As such, the advancement mechanism may be used by the inflation device to move the inflatable protective packaging units as a group; however, in alternative arrangements, the advancement mechanism may move individual ones of a group of inflatable protective packaging units supported by the track, as described herein.

In some embodiments, the advancement mechanism causes one or more of the inflatable protective packaging units to be moved to a filling position where the plurality of inflatable protective packaging units may be discretely inflated with a fluid. A detent or suitable feature that locates the inflatable protective packaging units advance along the track in the filling position. For example, the advancement mechanism can, in certain embodiments, advance the inflatable protective packaging units as a group (or individually) toward the detent. The detent may prevent advancement of the inflatable protective packaging units so that one of the inflatable protective packaging units is arranged at the filling position.

The inflation device may include a filling station that is configured to provide fluid and inflate the group of inflatable protective packaging units. In a particular embodiment, the filling station may include an inflation component that is coupled with a fluid source. The inflation component may be a nozzle that is configured to be received by the inflation component receiver of the inflatable protective packaging unit. The filling station may include one or more actuators that move the inflatable protective packaging unit past the detent and toward an exit of the inflation device. For example, the nozzle may be coupled with the one or more actuators and move the inflatable protective packaging unit; however, this is not required. In other cases, inflation component may disengage from the inflation component receiver upon inflation, and the inflatable protective packaging unit may be advanced toward the exit of the inflation device by another component, including a component coupled with the advancement mechanism and/or mechanism of other devices. It will be appreciated, that as described herein, "actuator" may refer to substantially any component that is suitable to induce a force or movement on another object or system. For example, the "actuator" may encompass electrically-activated components, hydraulic systems, pneumatic systems, and so on. In various embodiments, passive components such as a springs, weights, or other biasing components can suitably substitute the actuator.

The inflation device may be configured to separate portions of the inflatable protective packaging unit as the cushion is advanced toward the exit of the device and subsequently ejected. This may help prepare the inflatable protective packaging units for use in a particular packaging application and/or remove portions of the inflatable protective packaging unit that may be undesirable for use as packaging material, such as the inflation component receiver. As an example, the inflation component receiver suspends or aids in suspending the inflatable chambers of the inflatable protective packaging unit as the fluid chambers are inflated by the inflation device. The inflation component receiver may be a different, possibly more rigid material than the flexible plies. The inflation device may operate to separate the inflation component receiver from the flexible plies. As described in greater detail below, the inflatable protective packaging unit advances along a dispensing path, for example, after being inflated by the filling station. A separator may be positioned along the dispensing path and configured to detach the inflation component receiver from flexible plies that define the fluid chamber.

In some cases, the separator may be a ramp that is positioned on an underside of a support element that supports the inflatable protective packaging units. As the inflatable protective packaging unit is advanced along the dispensing path, the ramp contacts the flexible plies and causes the flexible plies to move in a direction different from that of the direction of the dispensing path. The inflation component receiver may continue along the dispending path, for example, due to the operation of one or more actuators described herein, and thus the flexible plies may be separated as the flexible plies and the inflation component receiver travel in directions different from one another. In some cases, the flexible plies (and associated inflated chamber(s)) may be ejected from the inflation device and into a first bin, and the inflation component receiver may be ejected into a second bin.

It will be appreciated that to facilitate the foregoing, various mechanical and electromechanical components and systems may be used to perform one or more operations of the inflation device. Sample components and systems, such as those of the inflatable protective packaging unit support mechanism, the advancement mechanism, the filling station, the separator, and/or other assemblies or subassemblies of the inflation device, are presented and described herein for purposes of illustration. As described herein, the assemblies and subassemblies of the inflation device may be interconnected, and as such, rather than discrete systems, may be coupled to one another and use common components. In this regard, it will be appreciated that different components may be used to facilitate the various functionalities of the inflation device described herein, and that the following assemblies are presented for explanatory purposes and should not be construed as limiting.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, skill, and knowledge of the relevant art are within the scope of the present inventive aspects.

Figure 1B:
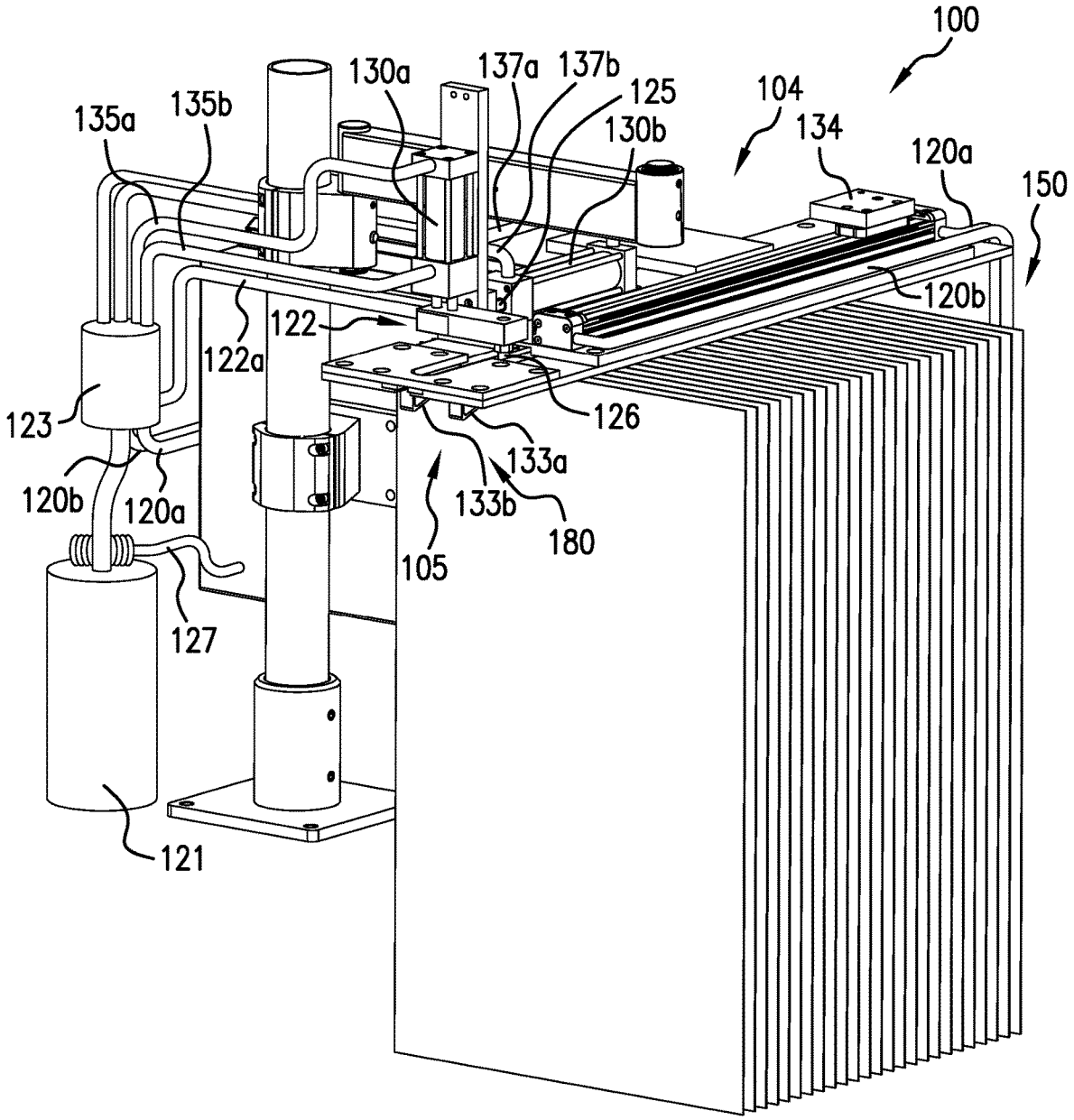
FIG. 1B depicts another perspective view of the inflation system.

FIGS. 1A and 1B depict an inflation system 100, such as the inflation system generally discussed above and described in greater detail below. The inflation system 100 may be configured to store, inflate, and dispense inflatable packaging materials. In some cases, the inflation system 100 may be configured to produce inflatable packaging materials in a batch, sequentially, and therefore limit downtime associated with, for example, loading a machine with uninflated packaging materials or other inputs. In some cases, the inflation system 100 stores, inflates, and/or dispenses the inflated packaging materials individually.

Broadly, the inflation system 100 may include an inflation device 104 and inflatable protective packaging units 150. The inflation device 104 may receive the inflatable protective packaging units 150 in an uninflated configuration. For example, the inflation device 104 may include an inflatable protective packaging unit support mechanism 110 that is configured to receive the inflatable protective packaging unit 150 and store the inflatable protective packaging unit 150 for subsequent discrete advancement toward a filling position or other portion of the device 104. Accordingly, the inflatable protective packaging unit support mechanism 110 may define a magazine that is used to support and store the inflatable protective packaging units, and is some cases, drive the units forward within the device. To facilitate the foregoing, the inflatable protective packaging unit support mechanism 110 may include a first wall portion 109*a* and a second wall portion 109*b*. The first wall portion 109*a* and the second wall portion 109*b* may cooperate to define a track 112. The track 112 may receive the inflatable protective packaging units 150 and define a path for movement of the inflatable protective packaging units 150.

The inflatable protective packaging units 150 may be moved along the track 112 by various actuators and associated assemblies, described herein. For purposes of illustration, FIG. 1A shows an advancement mechanism 116 that may be configured to advance the inflatable protective packaging units 150 along the track 112. In this sample embodiment, the advancement mechanism 116 may include a pusher 134 that extends at least partially into the track 112. The pusher 134 may be configured to discretely advance the inflatable protective packaging units held by the track 112, such as the inflatable protective packaging units 150 shown in FIG. 1A. For example, as described in greater detail below, the pusher 134 may couple with (e.g., contact or otherwise engage) a select a unit of the inflatable protective packaging units 150 held within the track 112 and cause the select cushion to move along the track 112, such as toward a filling position, exit, or other portion of the inflation system 100. In some cases, the pusher 134 may cause the select cushion to move, and in so doing, the select cushion may advance others of the inflatable protective packaging units 150 to move along the track 112. An actuator 138 may be used to move the pusher 134, which may be a hydraulic or pneumatically-operated actuator; however, in other cases, other actuators may be used. Additionally or alternatively, the pusher 134 may be resiliently-biased, for example, relative to a mount or other structure of the inflation device 104. The resilient-bias may include a spring, resilient material, and/or other device.

The inflatable protective packaging units 150 may be advanced along the track 112 and toward a filling station 122. The filling station 122 may be used to provide fluid to the inflatable protective packaging unit positioned at the filling position and/or other appropriate position. In various examples, the filling station 122 includes a fluid source port 125. The fluid source port 125 may be coupled with a hose, tube, or other conduit 122*a* that is used to deliver fluid to the inflation component 126 (e.g. nozzle). For purposes of illustration, FIG. 1B shows the fluid source port 125 as the port into the filling station 122 suitable for distribution into the packaging units 150. A tube hose of the like may be coupled into the opening. In other cases, other inflation component 126 may be coupled with a fluid source that is internally contained with the inflation device 104, among various other configurations. As described in greater detail below, the inflation component 126 may be a nozzle that is configured to be received by the inflatable protective packaging unit, such as a receiver or other component that directs air from the nozzle and into an inflatable chamber of the cushion.

The filling station 122 may also include one or more actuators that operate to move the inflatable protective packaging unit from the filling position and toward an exit region of the inflation device 104, such as exit region 105. In the embodiment of FIG. 1B, the filling station 122 may include a first inflation component actuator 130*a* and a second inflation component actuator 130*b*. The first inflation component actuator 130*a* may be configured to move the inflation component 126 in a first direction of motion, such as a direction at least partially into the track 112. The second inflation component actuator 130*b* may be configured to move the inflation component 126 in a second direction of motion, such as a direction along the track 112 and toward the exit region 105.

In operation, the first inflation component actuator 130*a* may move the inflation component 126 at least partially into the track, which may cause the inflation component 126 to engage the inflation cushion. In the engaged configuration, the filling station 122 may provide fluid to the inflatable protective packaging unit, thereby allowing the unit to inflate. The second inflation component actuator 130*b* may operate to use the inflation component 126 to move the cushion toward the exit region 105. For example, the inflation component 126 may be engaged with the inflatable protective packaging unit and the second inflation component actuator may cause the inflation component (and engaged cushion) to move toward the exit region 105. At the exit region 105, the inflation device 104 may cause the inflatable protective packaging unit to be ejected from the device. In some cases, as describe herein, the inflation device may also operate to separate inflated portions of the inflatable protective packaging units from, for example, a receiver used to suspend the inflated portions along the track of the inflation system 100.

The inflation device 104 may operate in manufacturing or commercial environments. The inflation device 104 may be used in conjunction with various structures, equipment, controls, and so forth, that facilitate use of the inflation device 104 in such environments. In the embodiment of FIG. 1A, the inflation device 104 is shown coupled to a support assembly 190. The support assembly 190 may include arms, which may pivot relative to one another. The support assembly 190 may therefore allow the inflation device 104 to be supported and optionally suspended over various other manufacturing and commercial equipment, such as a conveyor, bins, and so on. Pivoting may also allow for maneuverability of the inflation device 104 into various different positions, thereby allowing a producer to position the inflation device above different manufacturing equipment, increasing the adaptability and usability of the device.

In accordance with various embodiments, as illustrated in FIG. 1B, one or more of the devices may be connected to a fluid source 121. For various examples, the filling station 122 includes an inflation component 126 which is coupled with a fluid source 121. The filling station 122 can be connected via one or more conduits (e.g. 122*a*). Additionally or alternatively, inflation component actuator 130*a* is coupled with a fluid source 121. The inflation component actuator 130*a* can be connected via one or more conduits (e.g. 135*a*, 135*b*). Additionally or alternatively, the inflation component actuator 130*b* is coupled with a fluid source 121. The inflation component actuator 130*b* can be connected via one or more conduits (e.g. 137*a*, 137*b*). Additionally or alternatively, advancement mechanism 116 is coupled with a fluid source 121 via one or more conduits (e.g., 120*a*, 120*b*). The inflation component actuator 130*b* can be connected via one or more conduits (e.g. 137*a*, 137*b*). In various embodiments, the components can be connected directly to the fluid source 121. However, in other embodiments, the components can be connected to the fluid source 121 via a manifold 123 or other valve and/or control mechanism. The fluid source 121 can include a compressor or fluid source such as a canister or vessel containing a compressed fluid. The fluid can include a standard air composition, nitrogen, carbon dioxide, and/or other gas or combination of gases. In various embodiments, the fluid source and/or the manifold can be connected to a power supply 127. In some embodiments, the control and/or power for the fluid source or the manifold can come from the control system, which can be a part of the control panel 192.

The inflation device 104 may also be connected with a control panel, such as the control panel 192 shown in FIGS. 1A and 1B. The control panel 192 may be configured to control one or more functions of the inflation device 104. As a non-limiting illustration, the control panel 192 may be configured to control functions related to chamber inflation (e.g., filling pressure or inflation rate), electrical or pneumatic actuators, positioning of the inflation device 104, various maintenance operations, diagnostics, and/or other appropriate functions. In this manner, the control panel 192 may include, or be coupled with, any appropriate hardware (e.g., computing devices, data centers, switches), software (e.g., applications, system programs, engines), network components (e.g., communication paths, interfaces, routers), and the like (not necessarily shown in the interest of clarity) for use in facilitating any appropriate operations disclosed herein.

In the embodiment of FIGS. 1A and 1B, the control panel 192 is shown as having input/output hardware 182, which may be touch sensitive. The input/output hardware 182 may depict an output of the inflation device 104 (e.g., a status) or prompt a producer to perform one or more operations (e.g., maintenance, restocking, and so on). Possible assemblies forming the input/output hardware 182 include a liquid-crystal display (LCD), organic light emitting diode (OLED) display, light emitting diode (LED) display, or the like. The input/output hardware 182 may be used to manually control one or more functions of the inflation device 104. Possible functions include inflation speed, actuator directional control, and inflation device 104 positioning. The input/output hardware 182 may also provide outputs based on a condition of the inflation device 104, including a haptic or other vibrotactile effects. The control panel 192 is shown in FIG. 1A attached to the support assembly 190; however, this is not required. In other cases, the control panel 192 may be remote from the inflation device 104 and communicatively coupled over a network.

Figure 2A:
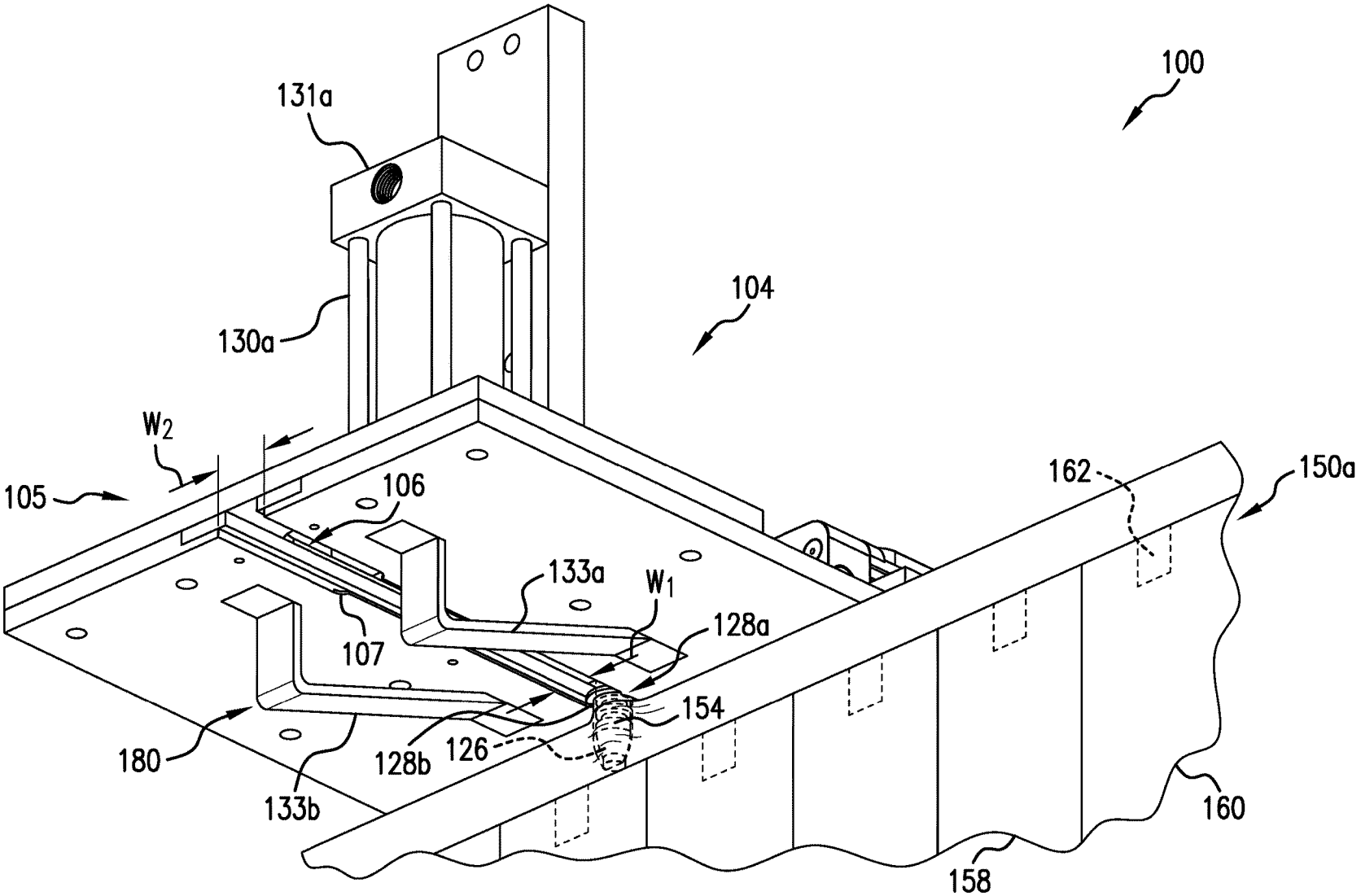
FIG. 2A depicts an underside view of the inflation system.
Figure 2B:
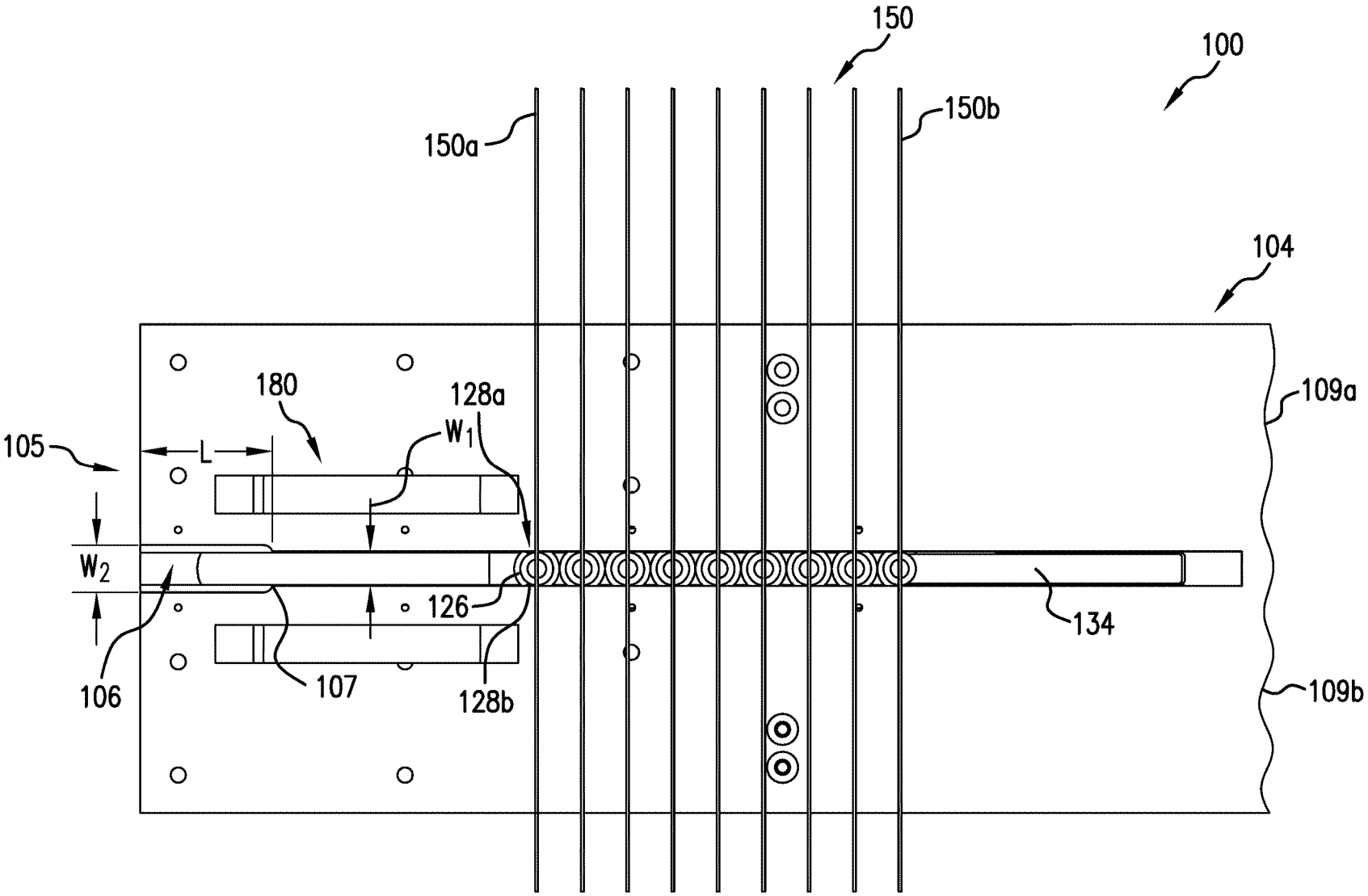
FIG. 2B depicts a bottom view of the underside of the inflation system.

FIGS. 2A and 2B depict an underside of the inflation system 100. In particular, FIGS. 2A and 2B depict components and assemblies that may be used to move the inflatable protective packaging units 150 along the track 112. Also shown are components and assemblies that may be used to inflate the inflatable protective packaging units 150 and eject the inflatable protective packaging units 150 at an exit region 105 of the inflation device 104.

As described in greater detail below with respect to FIGS. 4A-4E, the inflatable protective packaging units 150 may each be multi-component assemblies. This may allow the inflatable protective packaging units 150 to have a first component that is configured to be received by the inflation device 104 and another component that is configured to inflate and form the protective packaging. For purposes of illustration, a sample inflatable protective packaging unit 150*a* is shown in FIG. 2A having an inflation component receiver 154 and flexible plies 158. The flexible plies 158 may define one or more fluid chambers 160 that are inflatable when fluid is introduced. The flexible plies 158 may be separably attached to the inflation component receiver 154, such as by a friction fit, a frangible connection, or other technique that allows the inflation component receiver 154 to be detached from the flexible plies 158 without damaging the flexible plies 158.

The inflatable protective packaging unit 150*a* is also shown with a group of valve areas 162. As shown, the inflatable protective packaging unit 150*a* may have a valve area 162 at each of the fluid chambers 160. The valve area may include one or more structures, seals, adhesive, and the like described herein, that are configured to prevent fluid escape upon inflation of the inflatable packaging unit 150*a*. In various examples, the valve area 162 may include a check-valve, a heat seal, and other features.

The inflatable protective packaging unit 150*a* (or any of the inflatable protective packaging units 150) may be advanced along the track 112 using the inflation component receiver 154. For example, the inflation component receiver 154 may be received substantially between the first wall portion 109*a* and the second wall portion 109*b* that defines the track 112. The pusher 134 or other mechanism of the inflation device 104 may engage one of the group of inflatable protective packaging units 150 and cause the group of inflatable protective packaging units to move toward a filling position. The group of inflatable protective packaging units 150 may be arranged in a row along the track 112. As such, the pusher 134 may exert a force on one of the inflatable protective packaging units 150, such inflatable protective packaging unit 150*b* positioned furthest from the exit region 105 of the inflation device, which, in turn, causes the whole row of inflatable protective packaging units 150 to advance along the track 112. By advancing the whole row, inflatable protective packaging units 150 may cause a select inflatable protective packaging unit positioned nearest to the exit region 105, such as the inflatable protective packaging unit 150*a*, to advance into a filling position for subsequent inflation.

As described herein, one or more actuators may be used to manipulate the inflation component 126. In the example of FIG. 2A, a first filling station actuator 130*a* is shown. The first filling station actuator 130*a* may be coupled with the inflation component 126 and configured to move the inflation component 126 in one or more directions along the track 112. While the first filling station actuator 130*a* may be one or more of a variety of actuators, including electrically activated, spring-based, and the like, the first filling station actuator 130*a* is shown in FIG. 2A as a pneumatic actuator. As such, the first filling station actuator 130*a* may have a pneumatic port 131*a*. The pneumatic port may be coupled with a hose, conduit, or other component that is used to deliver pneumatic fluid to the first filling station actuator 130*a*.

Figure 2C:
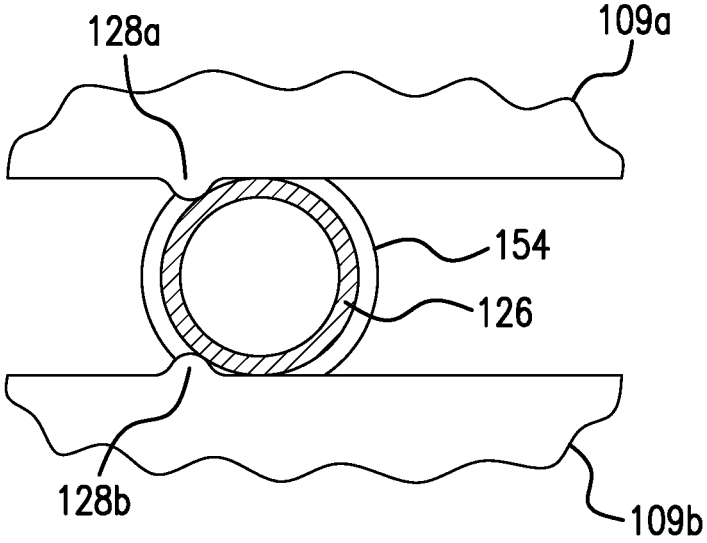
FIG. 2C depicts a cross-section view of the inflation component receiver and inflation component along the underside of FIG. 2B.
Figure 2D:
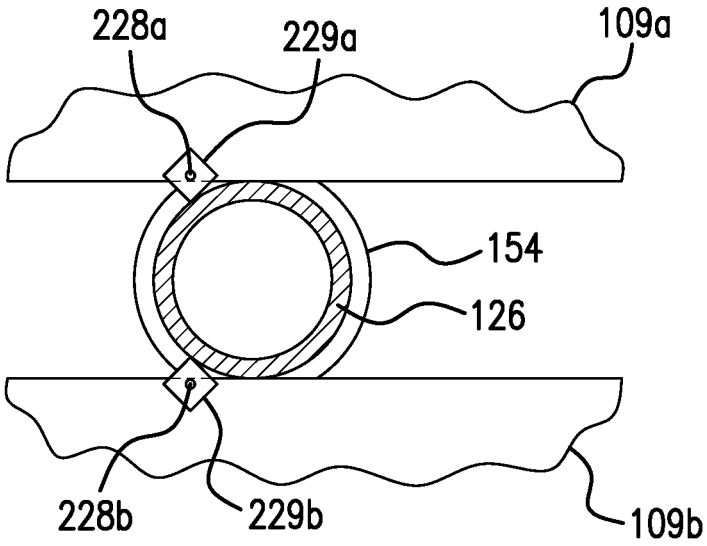
FIG. 2D depicts an alternative cross-section view of the inflation component receiver and inflation component along the underside of FIG. 2B.

For purposes of illustration, the filling position of the inflation device 104 may be defined by a position of the inflation component 126 shown in FIGS. 2A and 2B. More broadly, the filling position may be substantially any position along the track 112 at which the inflation device 104 may operate to discretely inflate the group of inflatable protective packaging units 150. In various examples, detents 128*a*, 128*b*, shown in FIG. 2C, may be positioned along the track 112 proximal the filling position. As shown the detents can be formed as a contiguous portion of the first wall portion 109*a* and the second wall portion 109*b* respectively. The detents 128*a*, 128*b* may be a reduced width portion of the track 112 that restrains movement of the inflatable protective packaging units 150. As such, the pusher 134 or other mechanism may operate to advance the group of inflatable protective packaging units 150 along the track 112 so that the detent engages the inflatable protective packaging unit 150*a* (or other inflatable protective packaging unit 150*b* positioned nearest the exit region 105) and restrains movement of the inflatable protective packaging unit 150 beyond the filling position. As explained in greater detail below with respect to FIGS. 8A-8E, one or more actuators may operate to move the inflatable protective packaging unit 150*a* beyond the detent and toward the exit region 105. This may allow the inflation device to inflate the inflatable protective packaging unit 150*a* at the filling position and subsequently eject the inflatable protective packaging unit 150*a*, for example, for use as protective packaging. In accordance with another example, the detent may be formed by constricting members 228*a*, 228*b*, shown in FIG. 2D. The constricting members 228*a*, 228*b*, are positioned along the track 112 proximal to the filling position. As shown, the constricting members 228*a*, 228*b*, can be attached to the first wall portion 109*a* and the second wall portion 109*b* respectively. In one example, fasteners 229*a*, 229*b* attach the constricting members 228*a*, 228*b*, to the first wall portion 109*a* and the second wall portion 109*b* respectively. The constricting members 228*a*, 228*b*, form a reduced width portion of the track 112 that restrains movement of the inflatable protective packaging units 150. In some embodiments, the constricting members 228*a*, 228*b* can be used in place of the detents 128*a* and 128*b* described above and throughout.

The inflatable protective packaging unit 150*a* (or any inflatable protective packaging unit) may have a separable inflation component receiver (e.g., inflation component receiver 154) and flexible plies (e.g., flexible plies 158). As such, once filled and adequately inflated, the inflation device 104 may operate to separate the inflation component receiver from the inflated packaging unit. Broadly, this separation may be accomplished by moving the inflation component receiver 154 along the track 112, while the inflated packaging unit is moved in another direction, e.g. down and away from the inflation component receiver 154. To facilitate the foregoing, the inflation system 100 may include a separator 132. In various embodiments, as illustrated in FIGS. 2A and 2B, the separator 180 may include a first ramp portion 133*a* and a second ramp portion 133*b*; however, other structures and assemblies are possible to execute the described functionality, as contemplated herein.

The separator 132 may cause the flexible plies 158 to move in a direction other than a direction of the track 112. For example, the first ramp portion 133*a* and/or the second ramp portion 133*b* may contact the flexible plies 158 as the inflatable protective packaging unit 150*a* is moved toward the exit region 105 by the inflation component receiver 154. The first ramp portion 133*a* and/or the second ramp portion 133*b* may prevent movement of the flexible plies along the track 112 and therefore cause the flexible plies 158 to separate from the inflation component receiver 154 as the inflation component receiver 154 continues to advance toward the exit region 105 of the inflation device 104. The flexible plies 158 may separate from the inflation component receiver 154 without substantially damaging the inflated chambers of the inflatable protective packaging unit. The inflation component receiver 154 may continue to advance toward the exit region 105, where it may be ejected from the inflation device 104 separately from the ejection of the corresponding inflatable protective packaging unit.

The track 112 may also be arranged to eject the inflation component receiver 154 from the inflation system 100. As described herein, the inflation component 126 may be used to advance the inflation component receiver 154 along the track 112 and to an exit region 105 of the inflation system. The track 112 may have multiple different widths along a length of the track to facilitate the movement of the inflation component receiver 154, and subsequent ejection at the exit region 105. In the example shown in FIGS. 2A and 2B, the track 112 may have at least a first width $W_1$ and a second width $W_2$. Broadly, the first width $W_1$ may be configured to accommodate a width of a body of the inflation component receiver 154 and generally be less than a width of a protrusion, lip, flange, and/or other feature (e.g., protrusion 408 of FIG. 4B). In this manner, the inflation component receiver 154 may be supported within the inflation system 100 by the track 112. For example, the protrusion or other feature may be positioned above the track 112, and thus the width $W_1$ may prevent or mitigate the inflation component receiver 154 from disengaging with the inflation system 100. And further, because the width $W_1$ is configured to accommodate a width of a body of the inflation component 126, the inflation component receiver 154 may generally be freely advanced along the track 112, for example, by the operation of the inflation component 126.

As shown in FIGS. 2A and 2B, the track also includes the second width $W_2$. The second width $W_2$ may generally be greater that the first width $W_1$. And in particular, the second width $W_2$ may be greater than a width of the protrusion, lip, flange, and so on of the inflation component receiver 154. In this manner, the track 112 may be arranged to eject the inflation component receiver 154 along a portion of the track 112 defined by the second width $W_2$. For example, the inflation component 126 may advance the inflation component receiver 154 along the track from the portion defined by the first width $W_1$ past a transition 107 and to a portion of the track defined by the second width $W_2$, such as the release portion shown in FIGS. 2A and 2B. Once positioned at or near the release portion 106, the inflation component receiver 154 may be ejected from the track 112. For example and as described in greater detail below with respect to FIGS. 8A-8E, the first filling station actuator 130*a* moves in an upward direction, thereby causing the inflation component 126 to separate from the inflation component receiver 154. In other cases, the movement of the inflation component 126 to or along the release portion may be sufficient to release the inflation component receiver 154 from the inflation component 126, thereby causing the inflation component receiver 154 to eject from the inflation system 100.

Figure 3:
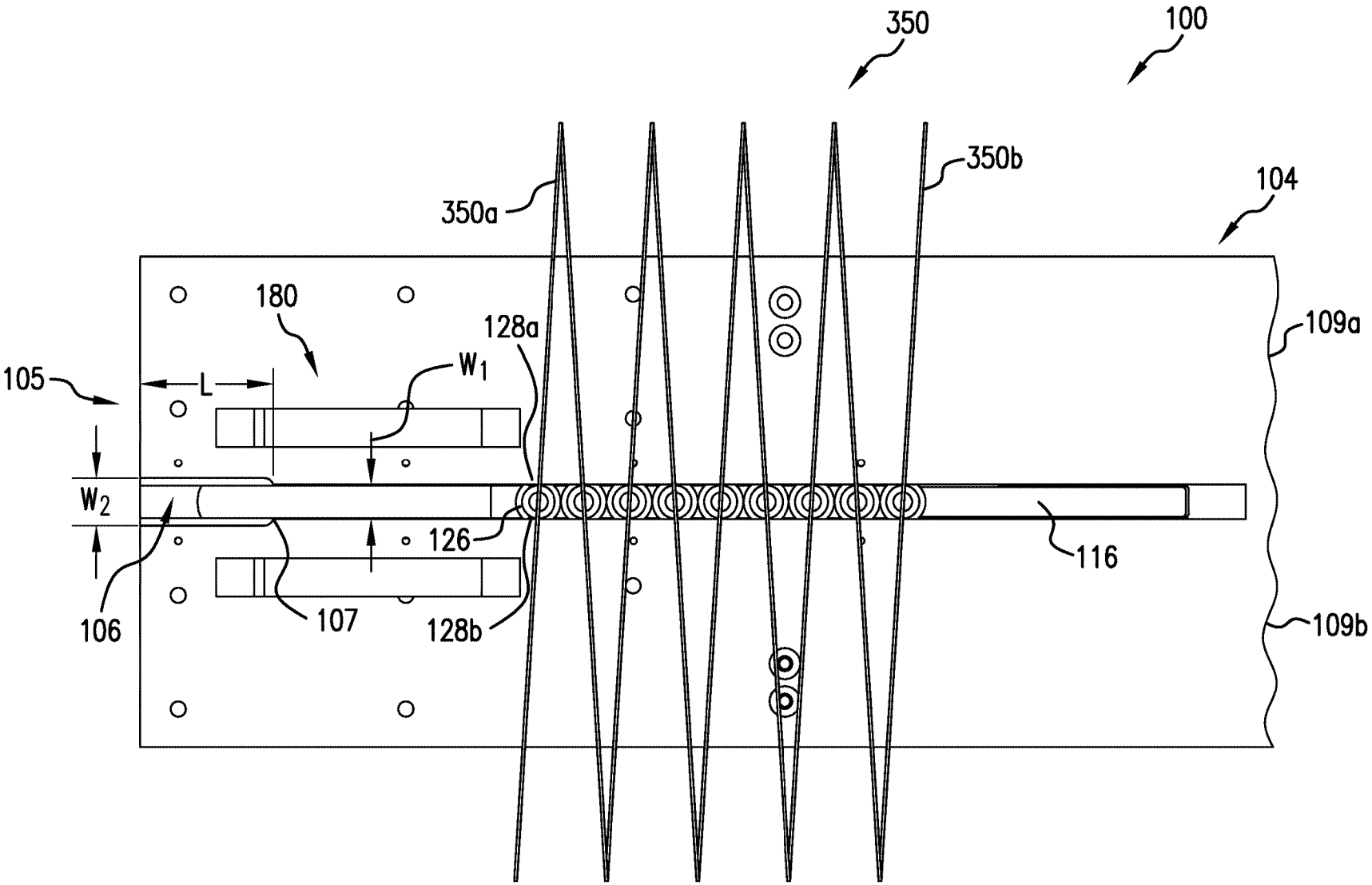
FIG. 3 depicts another embodiment of protective packaging units for use with the packaging inflation system of FIG. 2A.

FIG. 3 depicts another embodiment of protective packaging units for use with the packaging inflation system 100. As shown in the embodiment of FIG. 3, the packaging inflation system 100 may be operable to produce inflated protective packaging units from uninflated protective packaging units that are arranged in a fan-fold configuration. In particular, FIG. 3 shows uninflated protective packaging units 350 (e.g., units 350*a*, 350*b*) in a fan-fold configuration. In a fan-fold configuration, opposing edges of each individual protective packaging unit may be severeably attached to one another. This may allow the protective packaging unit 350 to be manufactured and shipped as a group of units, and subsequently loaded onto the track, magazine, and so forth in a group and/or subset of the shipped group.

In some cases, the packaging inflation system 100 may operate to separate each individual protective packaging unit. As one possibility, inflation and subsequent advancement of a protective packaging unit may cause the protective packaging unit to tear or separate from the other protective packaging units. In other cases, the packaging inflation system 100 may employ various other structures to facilitate the separation of the protective packaging units 350 from one other, including various cutting mechanisms, mechanical separators, and so forth. Additionally or alternatively, the protective packaging units 350 may be torn or otherwise manually separated by a user of the packaging inflation system, for example, which may be prior, or subsequent to, inflation of the protective packaging units.

FIGS. 4A-4E depict embodiments of inflatable protective packaging units. The inflatable protective packaging units of FIGS. 4A-4E may be used with the inflation device 104 described above with respect to FIGS. 1A-2B. As such, the inflatable protective packaging units described with respect to FIGS. 4A-4E may broadly correspond to an embodiment of the inflatable protective packaging units 150 described above with respect to FIGS. 1A-2B. It will be appreciated, however, that inflatable protective packaging units and inflatable packaging materials are more generally contemplated with the scope of the present disclosure. Accordingly, the inflatable protective packaging units shown in FIGS. 3-5 are various representations or examples of inflatable packaging materials that may be used with the inflation device 104, and are not meant to be limiting.

Figure 4A:
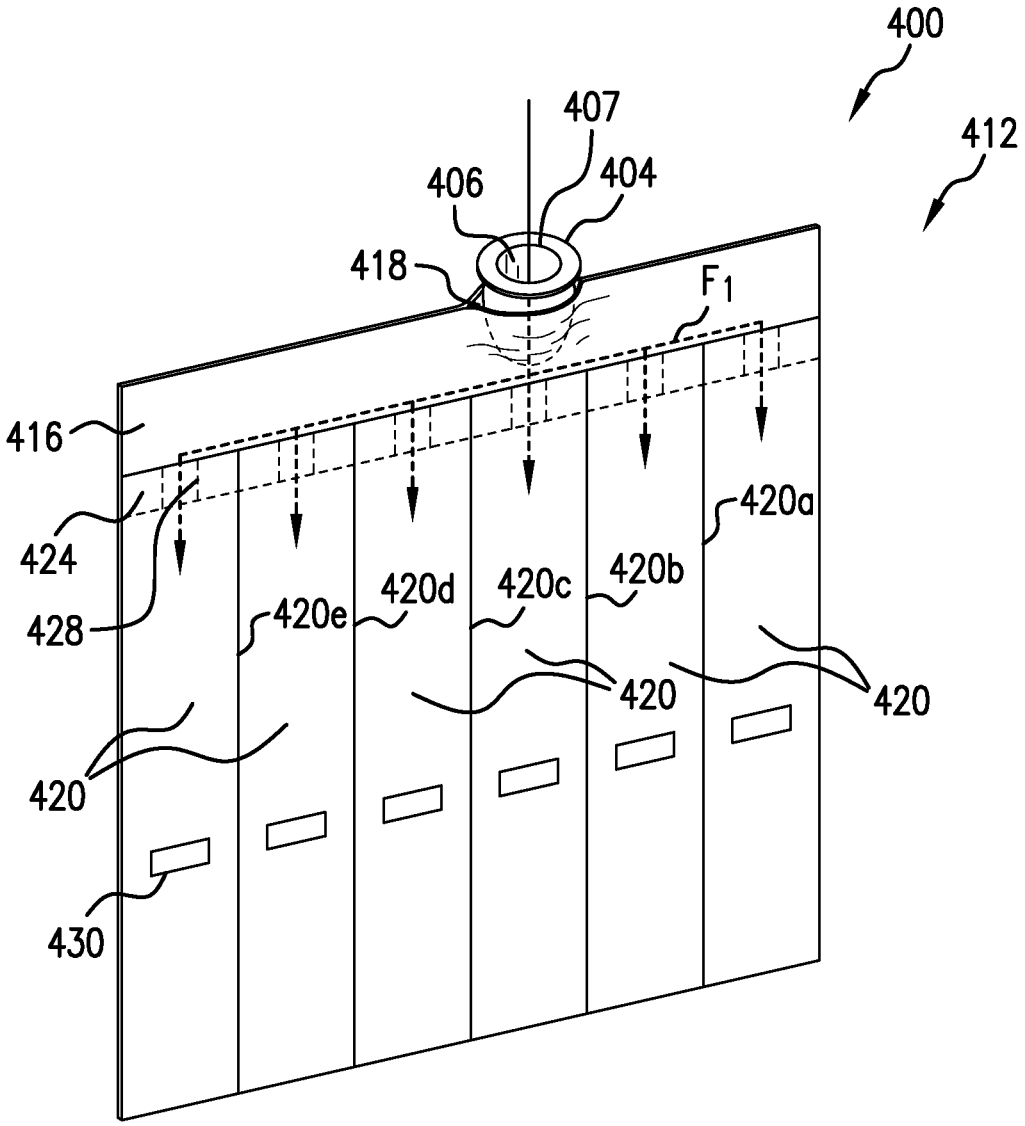
FIG. 4A depicts an embodiment of an inflatable protective packaging unit.

With respect to FIG. 4A, an inflatable protective packaging unit 400 is shown. The inflatable protective packaging unit 400 may be substantially analogous to one or more of the inflatable protective packaging units 150 described with respect to FIGS. 1A-2B. The inflatable protective packaging unit 400 may be a multi-component structure having one or more fluid chambers. The fluid chamber(s) may be inflatable with a fluid, thereby allowing the inflatable protective packaging unit 400 to inflate and be used as protective packaging. In some cases, such as in the embodiment shown in FIGS. 4A-4E, the inflatable protective packaging unit 400 may have an receiver 404 and a inflatable component 412. The receiver 404 may be a coupling, conduit, or other component having a channel 406 that is configured to direct fluid into one or more of the inflatable chambers of the inflatable component 412. The receiver 404 may also be used to support and move the inflatable component 412 with an inflation device (e.g., inflation device 104 of FIG. 1A). The receiver 404 may be separated from the inflatable component 412 and be discarded or recycled.

The inflatable protective packaging unit 400 may be a fluid-filled cushion (e.g., air cushion) at least partially made by sealing plies of plastic to form one or more flexible plastic inflation chambers that may be connected and adjoined parallel to or in series with one another. Where multiple chambers are present, an inflation region may operate to direct air to the chambers. This may be accomplished continuously or discretely. In some examples, all of the separate inflatable chambers may be connected together, while in other examples, the inflatable chambers may be separated from one another (e.g., such as using one-way check-valves, an inflation region, heat seal, and so on), thereby allowing each chamber to inflate and maintain an inflated state without substantially causing fluid to leak into the inflation region or other portion of the inflatable protective packaging unit. Once inflated, one or more air cushions are configured to surround and cushion a target item. An example of such an air cushion is the AIRSPEED® CHAMBERPAK™ by Pregis Corporation. Descriptions of other examples of inflatable air cushions can be found in, for example, U.S. Pat. No. 5,261,466, and U.S. Application Publication Nos. 2003/0108699, 2004/0163991, and 2005/0109656.

In the embodiment of FIG. 4A, the inflatable protective packaging unit 400 is shown having an inflation region 416 and a group of inflatable chambers 420. The inflation region 416 may be fluidly coupled to each of the group of inflatable chamber 420. The inflation region 416 may be configured to direct fluid from an external fluid source and into each of the group of inflatable chambers 420. In this regard, the inflation region 416 may define a fluid path $F_1$ shown in FIG. 4A that extends from an opening 418 of the inflatable protective packaging unit 400 into each of the group of inflatable chambers 420. During inflation, fluid may enter the inflatable protective packaging unit at the entrance 418 and flow into the group of fluid chambers 420. The inflatable chambers 420 may be defined by transverse seals 420*a*-420*e* with the chambers 420 located between the transverse seals 420*a*.

The inflatable protective packaging unit 400 may also include a valve area 424. Broadly, the valve area 424 is configured to allow flow (such as flow $F_1$ shown in FIG. 4A) into the inflatable chamber 420. In this manner, the valve area 424 may be a region of the inflatable component 412 that is in fluid communication with the inflation region 416. As such, while plies of the inflatable component 412 (e.g., first ply 450*a*, second ply 450*b* of FIGS. 4B and 4C) are generally sealed to one another to form the inflatable chamber 420, the valve area 424 may be, at least initially, an unsealed region between the plies. For example, an ink or other temporary masking layer may be applied to one or both of the plies that prevents the plies from sealing to one another at the valve area 424 (for example, during manufacturing of the inflatable component 412). This may allow the valve area 424 to receive the flow $F_1$ for inflation of the inflatable chambers 420.

Further, the valve area 424 may be a portion of the inflatable protective packaging unit 400 that is configured to prevent fluid escape from respective ones of the inflatable chambers 420 back into the inflation region 416. Valve area 424 may, in some embodiments, define or otherwise include one-way check valves 428 (as described in greater detail below with respect to FIGS. 4B and 4C) between the inflation region 416 and the group of inflatable chambers 420. Additionally or alternatively, the valve area 424 may include various adhesives and/or heat-seals that are used to prevent fluid escape from the group of inflatable chambers 420.

In some embodiments, the inflatable protective packaging unit 400 further includes seal segments 430. The seal segments 430 divide the inflatable chambers 420 into transverse chamber portions. The seal segments 430 may be aligned longitudinally and separated by seals that separate the inflatable chambers from one another. The seal segments 430 create bendable lines that allow the inflatable protective packaging unit 400 to bend or fold. Such flexibility may allow the inflatable protective packaging unit 400 to wrap around target protected items of various shapes and sizes.

Figure 4B:
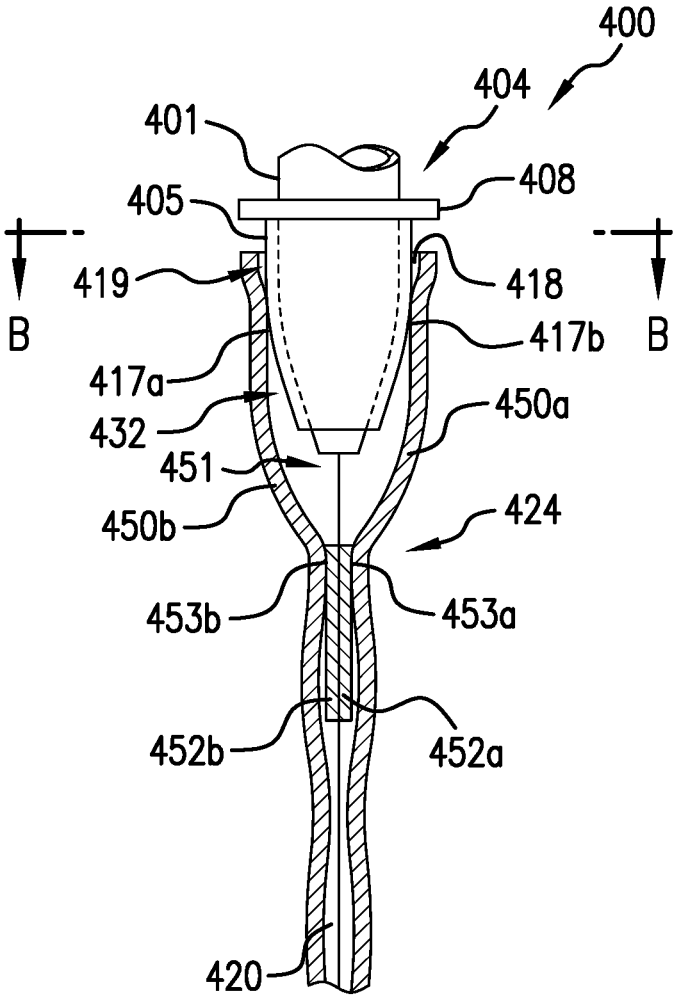
FIG. 4B depicts a cross-sectional view of an inflation component coupled with an inflatable protective packaging unit taken along line B-B, shown in an uninflated configuration.
Figure 4C:
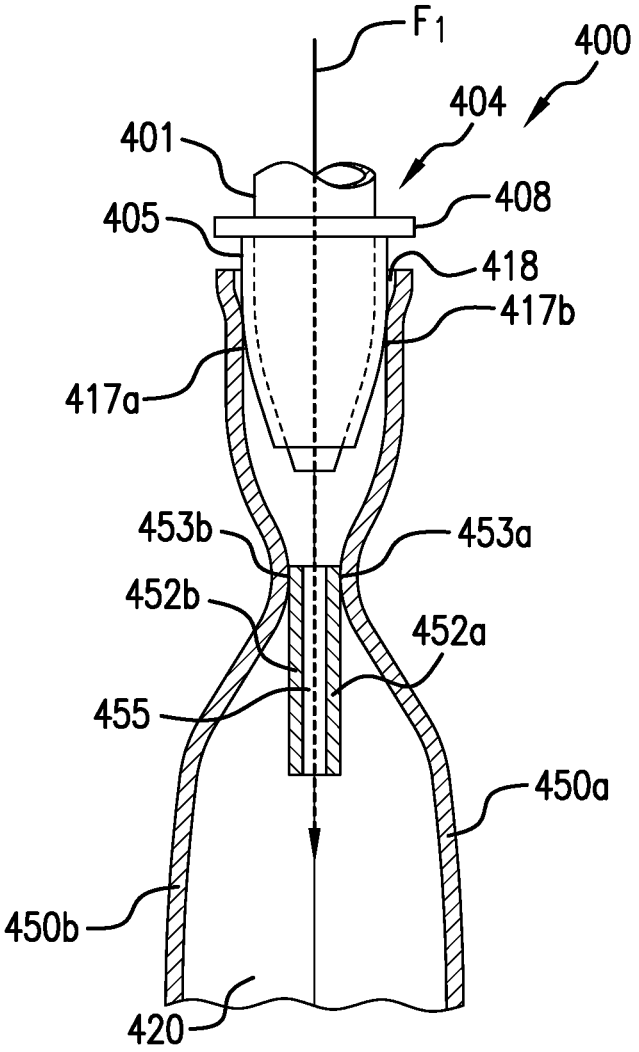
FIG. 4C depicts a cross-sectional view of an inflation component coupled with an inflatable protective packaging unit taken along line B-B, shown in an inflated configuration with a one-way valve being opened.
Figure 5:
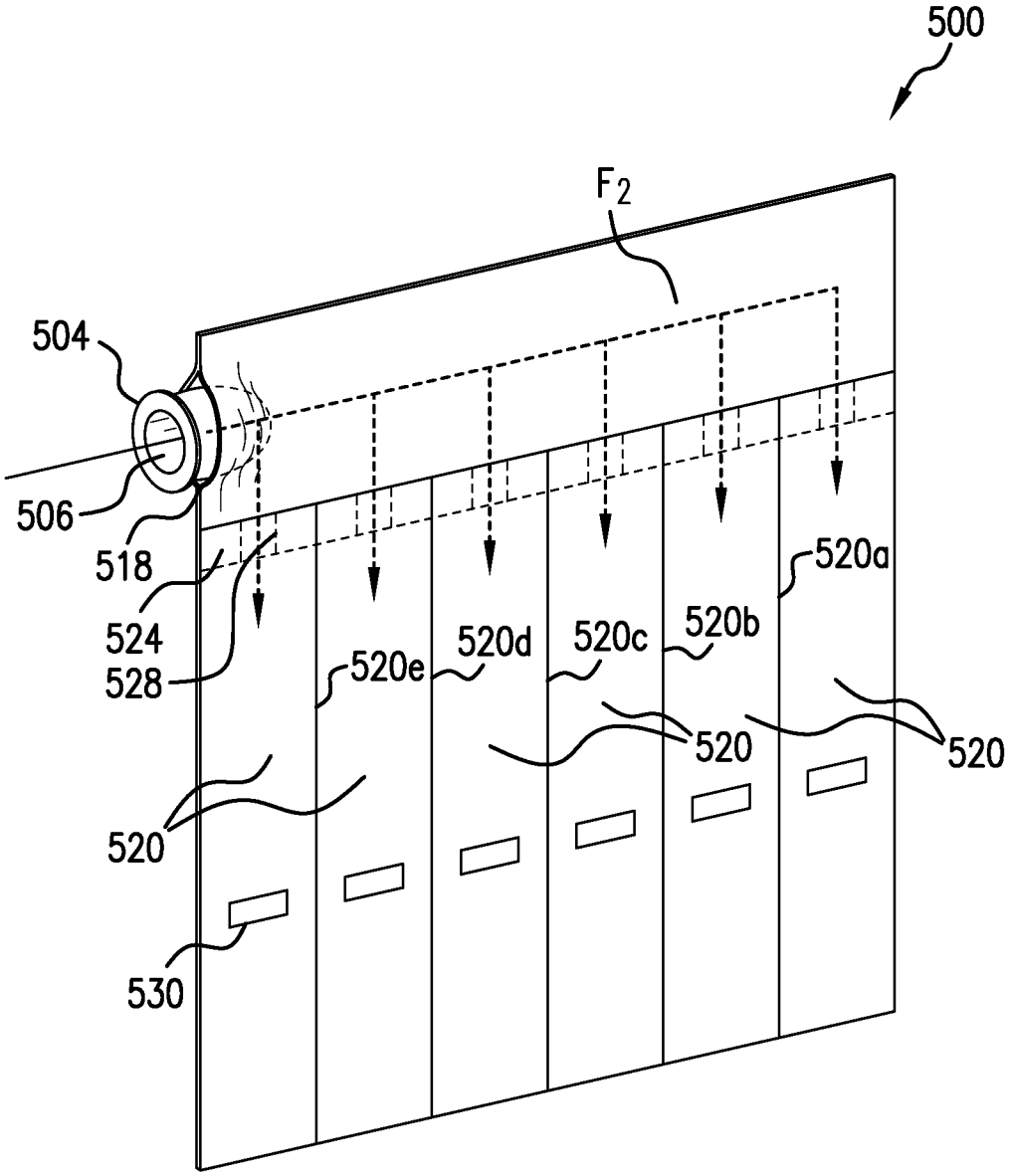
FIG. 5 depicts another embodiment of an inflatable protective packaging unit.

It will be appreciated that the inflatable protective packaging unit 400 may be constructed from various flexible materials, described herein. FIGS. 4B and 4C depict cross-sectional views of a sample construction of the inflatable protective packaging unit 400. In particular, the inflatable protective packaging unit 400 may be formed from at least a first ply 450*a* and a second ply 450*b*. The first ply 450*a* and the second ply 450*b* may be substantially flexible layers that cooperate to define, for example, the inflation region 416 and one or more of the group of inflatable chambers 420. For example, the first ply 450*a* and the second ply 450*b* may be heat sealed to one another in a predetermined pattern so as to define the inflation region 416, inflatable chambers 420, and/or other inflatable portion of the inflatable protective packaging unit 400. Such heat sealing processes may include adhesively bonding, friction, welding, fusion, heat sealing, laser sealing, and ultrasonic welding, among other possibilities. In this regard, first ply 450*a* and the second ply 450*b* may be similar or compatible materials for heat sealing. FIGS. 4B and 4C show a seam 451. The first ply 450*a* and the second ply 450*b* may be sealed or connection to one another along the seam 451.

The inflatable protective packaging unit may also include other flexible layers that may define a check valve, for example, at the valve area 424. As shown in FIGS. 4B and 4C, the inflatable protective packaging unit 400 may include a first flap 452*a* and a second flap 452*b* at the valve area 424. Generally, the first flap may be connected to the first ply 450*a* at a first connection 453*a*. Similarly, the second flap 543*b* may be connected to the second ply 450*b* at a second connection 453*b*. The first connection 453*a* and the second connection 453*b* may therefore direct flow (e.g., flow $F_1$ of FIG. 4A) between the first flap 452*a* and the second flap 452*b*, and as such, the flow may travel into the inflatable chamber 420 for subsequent inflation. For example, the first flap 452*a* and the second flap 452*b* can define a collapsible fluid passage 455. To facilitate the foregoing, the first flap 452*a* and the second flap 452*b* may extend between the inflation region 416 and a respective one of the inflatable fluid chambers 420. Broadly, the first flap 452*a* and the second flap 452*b* may cooperate to define a flexible passage that allows fluid into the inflatable chamber 420 from the inflation region 416. Upon inflation of the inflatable chamber 420, the first flap 452*a* and the second flap 452*b* may bend, buckle, or otherwise collapse due to the air pressure exerted on the first flap 452*a* and the second flap 452*b* from within the inflated inflatable chamber 420.

Figure 4D:
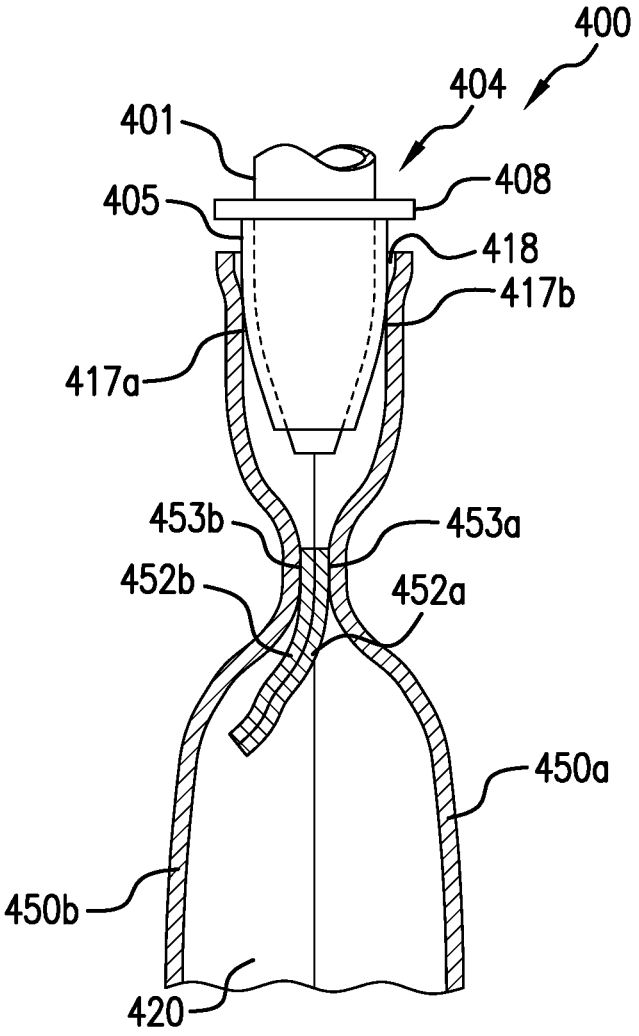
FIG. 4D depicts a cross-sectional view of an inflation component coupled with an inflatable protective packaging unit taken along line B-B, shown in an inflation configured with a one-way valve being closed.
Figure 4E:
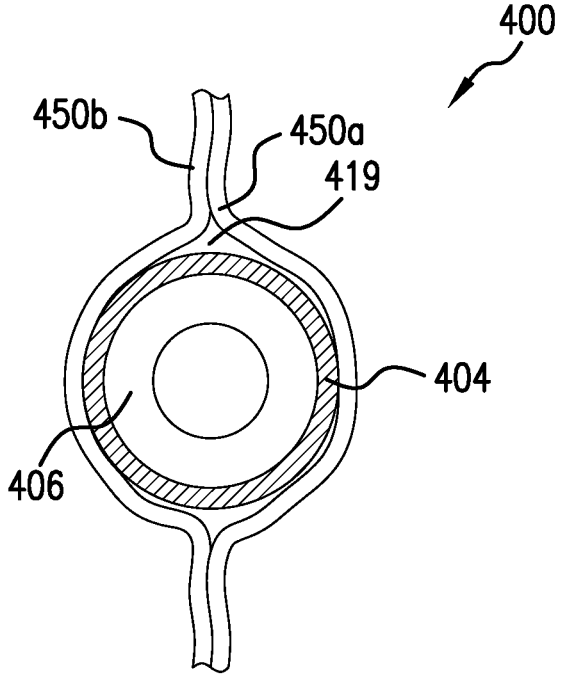
FIG. 4E depicts a top cross-sectional view of an opening of an inflatable protective packaging unit.

In an uninflated state, the inflatable protective packaging unit 400 may be substantially flat, for example, due to atmospheric pressure. FIG. 4B depicts a sample embodiment of this flat configuration. In the flat configuration, the check-valve may be in a substantially closed position. By inserting an inflation component, for example, into the receiver 404, or more generally the entrance 418, fluid can be delivered into the inflation region 416. Preferably, the operating pressure at which the fluid is delivered causes the first flap 452*a* and the second flap 452*b* to separate, thereby opening the check-valve and allowing fluid to pass into the inflatable chamber 420. FIG. 4C depicts a sample embodiment of such an inflated configuration. Once inflation of the inflatable chamber 420 is substantially complete, the pressure of the air within the inflation chamber 420 acts against the first flap 452*a* and the second flap 452*b* to keep the valve in the closed position, thus substantially preventing air from escaping and the cushion from deflating, as shown in FIG. 4D.

The check-valves may be formed in accordance with methods known to one of ordinary skill in the art in light of the disclosure herein. In one embodiment, the check-valves may include opposing the first flap 452*a* and the second flap 452*b*, which may be sandwiched between the first ply 450*a* and the second ply 450*b*. The internal surface of opposing first flap 452*a* and second flap 452*b* may include some ink. When heat is applied to the stack of opposing first flap 452*a* and second flap 452*b* sandwiched between the first ply 450*a* and the second ply 450*b*, all of the layers may fuse together except at a region having the ink on the internal surfaces. This inked region allows for fluid to pass through the collapsible channel substantially between the first flap 452*a* and the second flap 452*b*. And as such, the portion of opposing first flap 452*a* and second flap 452*b* internal to the inflatable chamber 420 defined between first ply 450*a* and second ply 450*b* may be kept closed by the internal chamber pressure, thereby allowing air into the chamber but not out of the chamber.

With further reference to FIGS. 4B and 4C, the receiver 404 is shown separably attached to the flexible plies 450*a*, 450*b* at the entrance 418. The receiver 404 is also show engaged with an inflation component 401. In particular, the receiver 404 is shown positioned at least partially within the opening 418 and extending into an inflation channel 422 of the inflatable protective unit. For example, the receiver 404 is shown having a body 405 with an internal wall defining the channel 406. The body 405 extends into the inflation channel 422 and is configured to deliver fluid to the inflatable chambers. The channel 406 may be a through portion of the receiver 404 that is configured to receive an inflation component, such as a nozzle or other device configured to deliver fluid, such as the inflation component 401 of FIGS. 4B and 4C. The interior profile of the channel 406 may correspond to a profile of a sample inflation component (e.g., inflation component 126 of FIG. 2A). This may allow the receiver 404 to couple with the inflation component 401 and optionally be manipulated by the inflation component, as described in greater detail below with respect to FIGS. 8A-8E.

The receiver 404 may include a protrusion 408. The protrusion 408 may be an exploded flange, lip, or other feature that extends outward from the body 405. The protrusion 408 may allow the inflatable protective packaging unit 400 to be received and supported with an inflation device. For example, the protrusion 408 may be received by a track or other feature of an inflation device, and as such, the inflatable protective packaging unit 400 may be supported or suspended from the inflation device via the engagement of the protrusion 408. In some embodiments, the protrusion 408 may be used to slide the inflatable protective packaging unit along the track.

The receiver 404 is shown in FIGS. 4B and 4C as having a taper. Generally, an outer contour of the body 405 may correspond to a geometry of the opening 418. For example, as shown in the top cross sectional view of FIG. 4E, the first ply 450*a* and the second ply 450*b* may substantially conform to or follow the contour of the exterior of the receiver 404. In various examples, despite this contour, the connection between the first ply 450*a* and the second ply 450*b* forms a loose passage to engage the component receiver 404, and thus gaps 419, described herein, may exist between one or more of the first ply 450*a*, the second ply 450*b*, and/or the receiver 404. The gaps 419 can be air-permeable gaps. Despite the loose, air-permeable seal between the plies and the receiver 404, fluid may be directed into the inflatable component 412 of the inflatable protective packaging unit through the inflation component receiver, and consequently cause the inflatable chambers to inflate. In some cases, the entrance 418 may be deformable or partially closed and the receiver 404 may be inserted into the entrance 418. This may allow the entrance 418 to sufficiently expand and thus receive fluid via the inflation component receiver for inflation of the fluidly coupled fluid chambers. In various embodiments, the connection between the first ply 450*a* and the second ply 450*b* forms a tight passage such that the receiver 404 can be tightly received into the passage formed thereby.

As described herein, the receiver 404 may be separably attached to the flexible plies 450*a*, 450*b*. This may allow the inflation component receiver to be discarded or recycled after inflation of the respective inflatable chambers. The receiver 404 may be separably attached to the flexibles plies 450*a*, 450*b* by a number of suitable methods, including by forming a frangible connection, a tight connection, or other separable connection. For example the tight connection can be formed by a friction fit or interference fit between the receiver 404 and the flexible plies 450*a*, 450*b*. In various examples, the frangible connection can be a semi-permanent connection between the inflation component receiver and the flexible plies. A semi-permanent connection may be one that is permanent but is easily separated, broken, severed, or the like, including spot welds, partial strong adhesives, complete weak adhesives, or any other combination or suitable adaptation of an attachment. For purposes of illustration, FIGS. 4B and 4C depict frangible connections 417*a*, 417*b*. The frangible connections may be spot welds, adhesives, and other features that separably attach the flexible plies to the receiver 404. The frangible connections 417*a*, 417*b*, or any other separable attachment technique described herein, may be severed when a force is applied to the receiver 404 or the flexible plies and thus cause the inflation component receiver and the flexible plies to separate. In other embodiments, other techniques may be used to separably attach the receiver 404 and the flexible plies 450*a*, 450*b* such that inflatable chamber 420 is not punctured, destroyed, and/or otherwise deflated upon detachment of the receiver 404 and the flexible plies 450*a*, 450*b*. The frangible connection can be any suitable connection that allows the component receiver and the flexible plies to separate under force by breaking the connection or a region proximal to the connection without severing the flexible plies in such a way as to limit the inflatable chambers ability to retain an inflation fluid.

In an embodiment, the receiver 404 may be separably attached to the flexibles plies 450*a*, 450*b* at the opening 418. The receiver 404 may form a loose connection with the flexible plies 450*a*, 450*b*. As such, as shown in FIGS. 4A-4E a gap 419 may be defined between the receiver 404 and the flexible plies 450*a*, 450*b*. The gap 419 may be air-permeable. Notwithstanding the gap 419, the receiver 404 may be configured to channel fluid into the one or more fluid chambers 420 of the inflatable protective packaging unit.

The receiver 404 may be constructed from a material distinct from that of the flexible plies 450*a*, 450*b*, and/or another component of the inflatable component 412 of the inflation component 404. For example, the component receiver 404 may be formed from a material that is more rigid than a material used to form the flexible plies 450*a*, 450*b*. The enhance rigidity of the receiver 404 may help the inflatable protective packaging unit 400 to be received, supported, and guided by the inflation device. For example, the receiver 404 may be constructed from a material that may not tear, deform, or damage due to a given force to the same extent as the material used to form the inflatable component 412. As such, the inflation device may exert forces on the inflation component receiver (e.g., for advancement toward a filling position, ejection, and so on), that may otherwise be inappropriate for the material of the inflatable component 412. The distinct material of the receiver 404 may in some cases render the receiver 404 unsuitable for use as a packaging material. As such, as described herein, the inflation device may detach the inflation component receiver from the inflatable component 412 and eject each from the device separately.

In one embodiment, the receiver 404 defines an entry opening 407 that faces and is open to the exterior to receive the fluid and direct it into the inflation region 416 of the inflatable component 412. For example, the receiver 404 can define an entry, avenue, passage, duct, and so, for fluid to flow into and through the receiver 404 and enter the inflatable component 412 for inflating one or more chambers 420 of the component 412, such as via the inflation region 416. In some cases, as described herein, the receiver 404 can define an entry for fluid into an inflation region 416 of the inflatable component 412, where the inflatable region can guide the fluid within the inflatable component 412 into one or more respective chambers 420.

To facilitate the foregoing, in the embodiments of FIGS. 4A-4E, the receiver 404 can have a rigidity that is greater than a rigidity of the inflatable component 412. For example, in the embodiment shown, the receiver 404 can be formed from a hard to semi-rigid material, while the inflatable component 412 can be significantly more flexible or deformable, typically made from flexible material. In this embodiment, the receiver 404 is sufficiently rigid to maintain open the entry opening 407 so that it is ready to receive an inflation component 658 or a flow of the inflation fluid in another manner. This can facilitate fluid entry into the inflatable component 412 in a variety of manners, including via automatic and manual techniques, which may, in some cases, be facilitated by an inflation machine or other associated components, including the inflators described herein.

The receiver 404 can also be configured to receive the fluid and direct it into the inflatable component 412, such as by directing it into the inflation region 416, by receiving the fluid directly, for example by blowing the fluid into the entry opening 407 of the receiver 404, or by inserting an inflation component, such as a nozzle or other inflator through which fluid is dispensed, to pass the fluid through the entry opening 407 and at least partially into the channel 406. The receiver 404 can include a ring, body, tube or other structure that generally guides the inflator toward the inflation region of the inflatable component 412.

It will be appreciated, however, the receiver 404 can, in certain embodiments, be flexible, deformable and/or otherwise have a similar rigidity to that of the inflation component 412. For example and as described in greater detail below with respect to FIG. 11, the receiver 404 and inflation component 412 may remain connected upon inflation of the inflation chambers 420, and thus it could be desirable to construct the receiver 404 and the inflation component 412 from the same or similar materials. In other embodiments, the entry 407 can be closeable, including being equipped to receive a cap, stopper, and/or otherwise employ various devices or techniques to substantially cease fluid flow into the component 412, including deforming or collapsing when inflation ceases. These, and other constructions of the receiver 404 are described and contemplated throughout the various embodiments below.

To facilitate the foregoing, the inflatable protective packaging unit 400, including the plies 450*a*, 450*b*, and the receiver 404, may be formed from any of a variety of materials known to those of ordinary skill in the art. Such materials can include, but are not limited to, ethylene vinyl acetates (EVAs), metallocenes, polyethylene resins such as low density polyethylene (LDPE), linear low density polyethylene (LLDPE), and high density polyethylene (HDPE), and blends thereof. Other suitable materials and constructions can be used. The inflatable protective packaging units 400 may include components that may be rolled on a hollow tube, a solid core, or folded in a fan-folded box or in another desired form for storage and shipment.

In some embodiments, the plies 450*a*, 450*b* are between 10 and 100 microns thick. In some embodiments, the plies 450*a*, 450*b* are at least 20 microns thick. For example, in an embodiment, the plies 450*a*, 450*b* may be between 50 and 75 microns thick.

In some embodiments, the plies 450*a*, 450*b* are made from a co-extruded material that contains nylon. For example, the plies 450*a*, 450*b* may be made from polyethylene and nylon. Materials containing nylon serve as an air barrier and retain the air over the shipping and storage cycle of shoes. Other suitable materials and constructions can be used.

A monolayer or multilayer polymeric film material may also be used. Each ply, for example, may be made from a monolayer or multilayer film. Monolayer films are typically made of polyethylene, although other suitable polymers may be used. The one or more layers of multilayer film embodiments may include polymers of differing compositions. In some embodiments, the disclosed layers may be selected from ethylene, amide, or vinyl polymers, copolymers, and combinations thereof. The disclosed polymers can be polar or non-polar. The disclosed ethylene polymers may be substantially non-polar forms of polyethylene. In many cases, the ethylene polymer may be a polyolefin made from copolymerization of ethylene and another olefin monomer, for example an alpha-olefin. The ethylene polymer may be selected from low, medium, or high-density polyethylene, or a combination thereof. In some cases, the density of various polyethylenes may vary, but in many cases the density of low-density polyethylene may be, for example, from about 0.905 or lower to about 0.930 g/cm3; the density of medium-density polyethylene may be, for example, from about 0.930 to about 0.940 g/cm3; and high-density polyethylene may be, for example, about 0.940 to about 0.965 g/cm3 or greater. Other suitable densities of various polyethylenes may be used. The ethylene polymer may be selected from linear low-density polyethylene (LLDPE), metallocene linear low-density polyethylene (mLLDPE), high-density polyethylene (HDPE), medium-density polyethylene (MDPE), and low-density polyethylene (LDPE).

In some embodiments, the polar polymer may be a non-polar polyethylene which may be modified to impart a polar characteristic. In other embodiments, the polar polymer may be an ionomer (e.g., copolymers of ethylene and meth acrylic acid (E/MAA)), a high vinyl acetate content EVA copolymer, or other polymer with polar characteristics. In one embodiment, the modified polyethylene may be anhydride modified polyethylene. In some embodiments, the maleic anhydride is grafted onto the olefin polymer or copolymer. Modified polyethylene polymers may react rapidly upon coextruding with polyamide and other ethylene containing polymers (e.g., EVOH). In some cases, a layer or sublayer comprising the modified polyethylene may form covalent bonds, hydrogen bonds, and/or dipole-dipole interactions with other layers or sublayers, for example, sublayers or layers comprising a barrier layer. In many embodiments, modification of a polyethylene polymer may increase the number of atoms on the polyethylene that are available for bonding. For example, modification of polyethylene with maleic anhydride adds acetyl groups to the polyethylene, which may then bond with polar groups of the barrier layer, for example, hydrogen atoms on a nylon backbone. Modified polyethylene may also form bonds with other groups on the nylon backbone as well as polar groups of other barrier layers, for example, alcohol groups on EVOH. In some embodiments, a modified polyethylene may form chain entanglements and/or van der Waals interactions with an unmodified polyethylene.

The layers of the plies 450*a*, 450*b* may be adhered or otherwise attached together, for example, by tie layers. In other embodiments, one or more of the plies 450*a*, 450*b* are a single layer of material, for example, a polyethylene layer.

Mixtures of ethylene and other molecules may also be used. For example, ethylene vinyl alcohol (EVOH) is a copolymer of ethylene and vinyl alcohol. EVOH has a polar character and can aid in creating a gas barrier. EVOH may be prepared by polymerization of ethylene and vinyl acetate to give the ethylene vinyl acetate (EVA) copolymer followed by hydrolysis. EVOH can be obtained by saponification of an ethylene-vinyl acetate copolymer. The ethylene-vinyl acetate copolymer can be produced by a known polymerization, such as solution polymerization, suspension polymerization, emulsion polymerization and the like, and saponification of ethylene-vinyl acetate copolymer can be also carried out by a known method. Typically, EVA resins are produced via high pressure autoclave and tubular processes.

Polyamide is a high molecular weight polymer having amide linkages along the molecular chain structure. Polyamide is a polar polymer. Nylon polyamides, which are synthetic polyamides, have favorable physical properties of high strength, stiffness, abrasion, and chemical resistance, and low permeability to gas, for example oxygen.

FIG. 5 depicts another embodiment of an inflatable protective packaging unit for use with one or more of the packaging inflation systems described herein. In particular, FIG. 5 depicts an inflatable protective packaging unit 500. The inflatable protective packaging may be substantially analogous to the inflatable protective packaging 400 described above (with respect to FIGS. 4A-4E). For example, the inflatable protective packaging unit 500 may be an inflatable packaging material that is inflatable by the inflatable packing system (e.g., inflation system 100 of FIG. 1A). Further, the inflatable protective packaging 500 may include a protective packaging portion and a more rigid inflation receiver component that is detachable from the inflation receiver component by operation of one or more components of the inflation system. In this regard, in relation to the embodiments of FIG. 4A-4E, the inflatable protective packaging unit 500 may broadly include: an inflation component receiver 504, a channel 506, an opening 518, valve area 524, one-way check valve 528, inflatable chambers 520, transverse seals 520*a*-520*e*, seal segments 530, and a flow $F_2$; redundant explanation of which is omitted here for clarity.

Notwithstanding the foregoing similarities, the inflatable protective packaging unit 500 depicts that opening 518 along a transverse edge. In this manner, as shown in FIG. 5, the inflation component receiver 504 may be received by the opening 518 and also position along the transverse edge of the inflatable protective packaging unit 500. The flow $F_2$ may therefore enter the inflation chamber or other inflatable region of the inflatable protective packaging unit 500 at the transverse edge. This may allow the inflatable protective packaging unit 500 to be loaded into a packaging inflation system in an orientation that is distinct from that shown in FIGS. 1A and 1B. For example, the inflatable protective packaging unit 500 may be loaded into a packaging inflation system in a substantially sideways or perpendicular orientation, which may facilitate filing.

Figure 6:
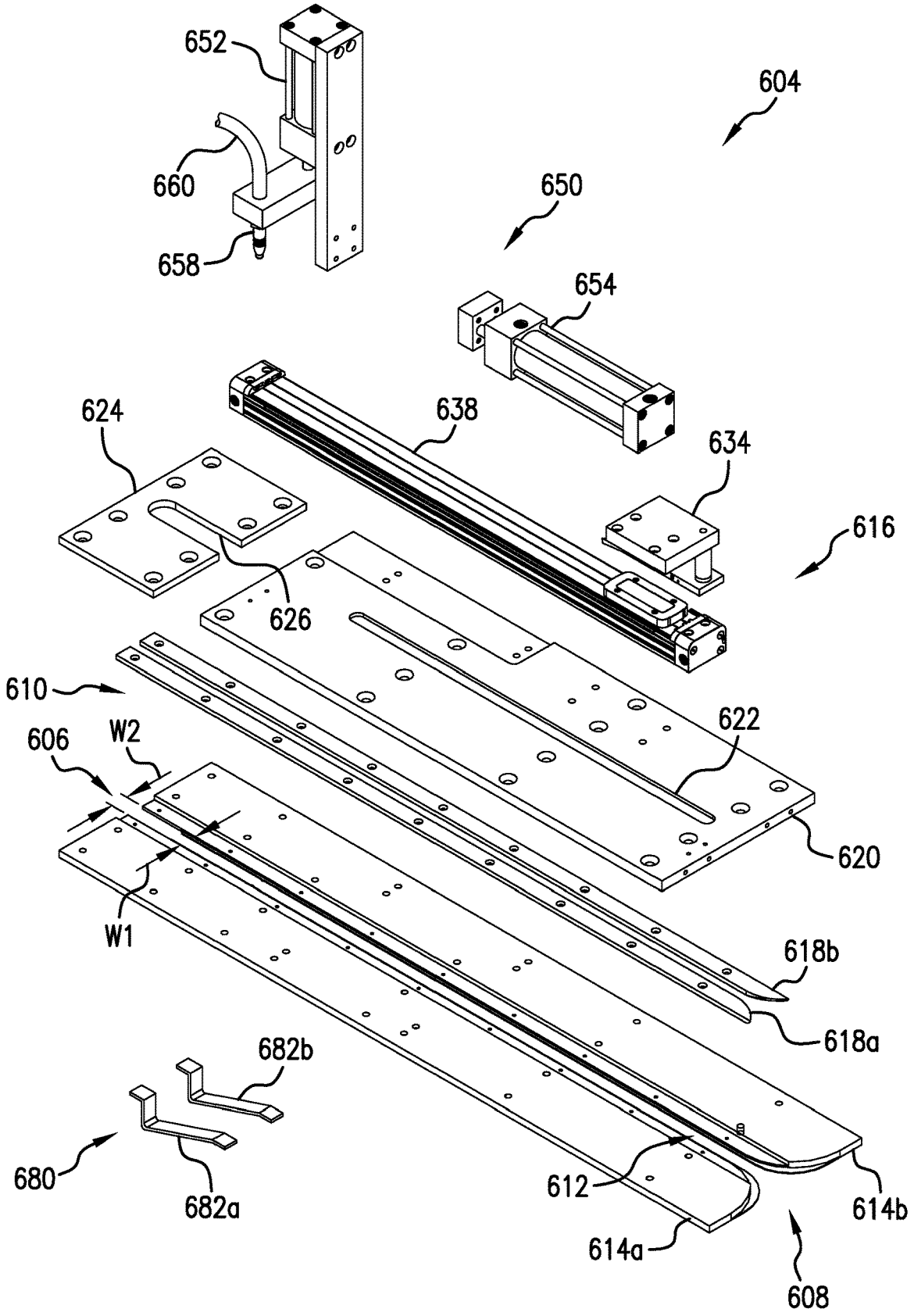
FIG. 6 depicts an exploded view of an inflation system.
Figure 7:
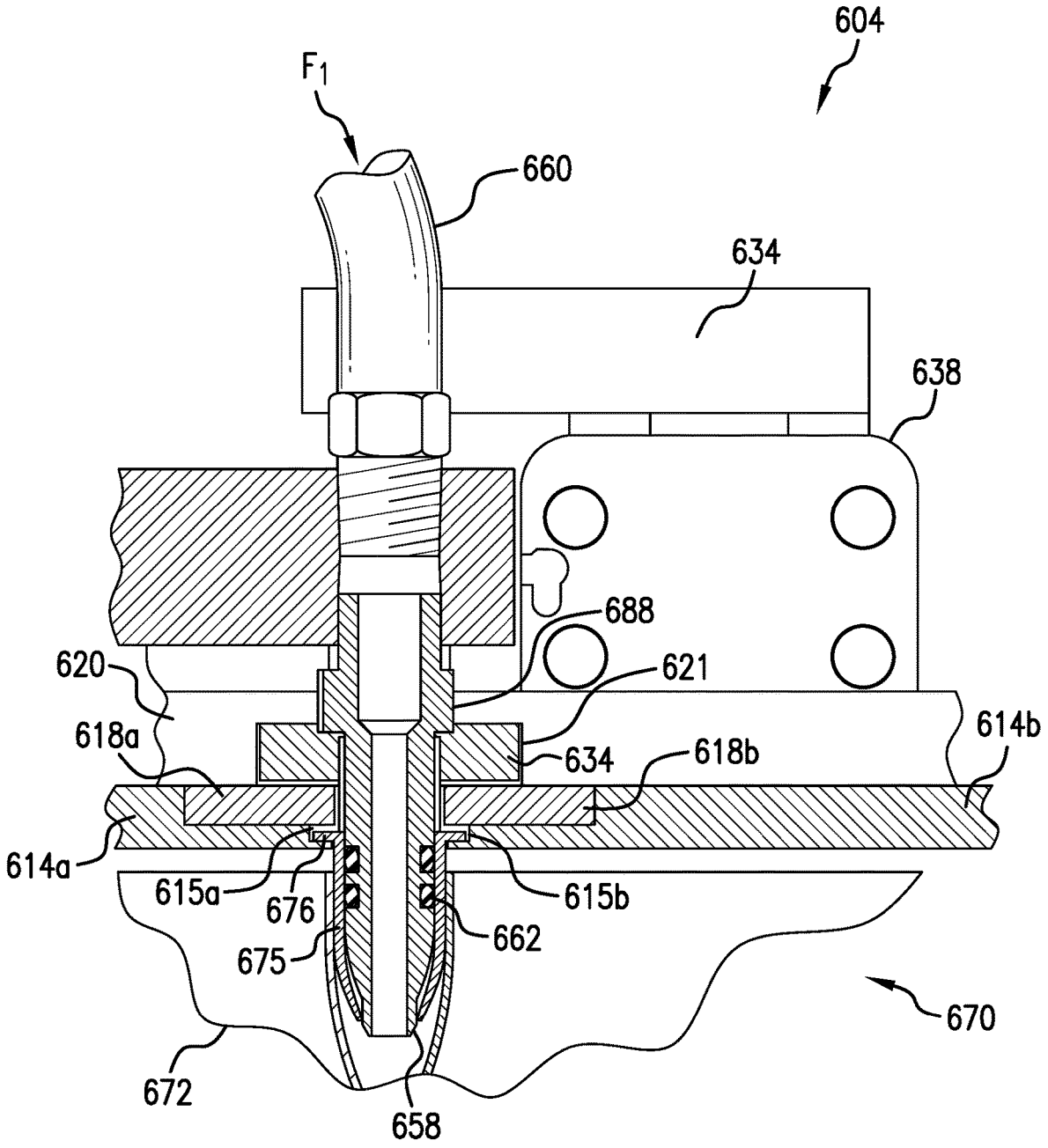
FIG. 7 depicts a cross-sectional view of the inflation system of FIG. 1A, taken along line A-A of FIG. 1A.

The inflatable protective packaging unit 400, 500, and/or any of the inflatable units described herein, may be used with any of the inflation devices described herein. Turning now to FIGS. 6 and 7, an inflation device 604 is shown, according to one or more embodiments of the present disclosure. The inflation device 604 shown and described with respect to FIGS. 6 and 7 may be substantially analogous to the inflation device 104 shown and described with respect to FIGS. 1A-2B. For example, the inflation device 604 may be configured to receive a group of inflatable protective packaging units and discretely inflate each of the cushions at a filling station. Further, the inflation device 604 may be configured to separate portions of the inflatable protective packaging unit, such as separating an inflation component receiver (which may be substantially rigid) from flexible plies that form inflatable chambers of the cushion. In this regard, substantially analogous to the components described in relation to the embodiments of FIGS. 1A-2B, the inflation device 604 may broadly include: an inflatable protective packaging unit support mechanism 610, an advancement mechanism 616, a filling station 650, and a separator 680; redundant explanation of which is omitted here for clarity.

FIG. 6 presents an exploded view of the inflation device 604. In the embodiment of FIG. 6, the inflatable protective packaging unit support mechanism 610 may include a first wall portion 614*a* and a second wall portion 614*b*. The first wall portion 614*a* and the second wall portion 614*b* may cooperate to define a track 612 that extends substantially from an entrance region 608 of the inflation device 604 to an exit region 610 of the inflation device 604. The track 612 may be configured to receive inflatable protective packaging units (e.g., inflatable protective packaging units 150 of FIG. 1A) and advance the inflatable protective packaging units through the inflation device 604 for inflation and subsequent ejection and use as protective packaging material. To facilitate the foregoing, as described in greater detail below, each of the first wall portion 614*a* and the second wall portion 614*b* may include recessed features, grooves, indents, or the like that may be configured to receive a protrusion or other feature of an inflatable protective packaging unit. This may allow the inflatable protective packaging units to be supported or suspended from the track 612 as the inflatable protective packaging units are advanced between the entrance region 608 and the exit region 610.

Various components, such as covers, plates, structural support members, and so on may be connected to the first wall portion 614*a* and/or the second wall portion 614*b*, according to one or more embodiments. This may structurally couple the first wall portion 614*a* and the second wall portion 614*b* to one another. More broadly, this may also allow the inflatable protective packaging unit support mechanism to be connected to other components, assemblies, and subassemblies of the inflation device 604.

For purposes of illustration, FIG. 6 shows a first track cover 618*a*, a second track cover 618*b*, an engagement member 620, and a filling station member 624. It will be appreciated, however, that more or fewer components may be used to couple the first wall portion 614*a* and/or the second wall portion 614*b* (or other components that define the track 612) to structures of the inflation device 604. And in some cases, the inflatable protective packaging unit support mechanism 610 may be defined by a single, substantially unitary component that defines the track 612, and as such may be directly coupled to, for example, the advancement mechanism 616, the filling station 650, the separator 680, and so on of the inflation device 604, without intervening layers of support members.

In the embodiment of FIG. 6, the first track cover 618*a* and the second track cover 618*b* may extend along a direction of the track 612. The first track cover 618*a* may be received by a top surface of the first wall portion 614*a* and the second track cover 618*b* may be received by a top surface of the second wall portion 614*b*. The first track cover 618*a* may cooperate with the first wall portion 614*a* to define a first recessed support region (e.g., recessed support region 615*a* of FIG. 7) that is configured to receive a feature of the inflatable protective packaging unit. Similarly, the second track cover 618*b* may cooperate with the second wall portion 614*b* to define a second recessed support region (e.g., recessed support region 615*b* of FIG. 7) that receive a feature of the inflatable protective packaging unit. Accordingly, once received within the respective recessed support regions, first wall portion 614*a* and the second wall portion 614*b* may support the inflatable protective packaging unit, while the first track cover 614*a* and the second track cover 614*b* may hinder or otherwise limit movement of the inflatable protective packaging unit in one or more directions. As such, the first wall portion 614*a*, the second wall portion 614, the first track cover 618*a*, the second track cover 618*b* may cooperate to define one or more limiting surfaces within the track 612. The limiting surfaces may prevent or mitigate the inflatable protective packaging units from lifting out of the track 612. In other cases, other supports, guides, posts, detents, and so may prevent or control movement of the inflatable protective packaging units, such as preventing movement of the units away from the track 612. In this manner, to the extent that the inflation device exerts a force on the inflatable protective packaging unit, such force may cause the inflatable protective packaging unit to move along a direction of the track 612.

Positioned over the first track cover 618*a* and the second track cover 618*b* may be the engagement member 620 and the filling station member 624. In the embodiment of FIG. 6, the engagement member 620 may be a plate that is used to structurally couple components that define the track 612 (e.g., first wall portion 614*a*, second wall portion 614*b*, first track cover 618*a*, second track cover 618*b*, and so on) with other components and assemblies of the inflation device 604, including various actuators, inflation components, controls, and so on. The engagement member 620 may define an elongated opening 622 that extends along a direction of the track 612. The elongated opening 622 may be configured to allow features of the advancement mechanism 616, for example, to extend through the engagement member 620 and into the track 612.

The filling station member 624 may also be a plate that is used to structurally couple components that define the track 612 with other components and assemblies of the inflation device 604. The filling station member 624 may be positioned near the end region 606 of the inflation device 604, such as about a filling position or other position where an inflation component may be used to provide fluid to an inflatable protective packaging unit. As such, the filling station member 624 may define an elongated slot 626. The elongated slot 626 may be positioned along a direction of the track 612. The elongated slot 626 may allow an inflation component, such as a nozzle from the filling station 650, to extend through the filling station member 624 and into the track 612.

Positioned above the inflatable protective packaging unit support mechanism 610 may be the advancement mechanism 616. The advancement mechanism 616 may be configured to advance inflatable protective packaging units that are received by the inflatable protective packaging unit support mechanism 610 along a direction of the track 612. To facilitate the foregoing, the advancement mechanism 616 may include a pusher 616. The pusher 616 may be connected to an actuator 638. The pusher 616 may include at least a first portion that is coupled to the actuator and a second portion that extends into the track 612.

The pusher 616 is shown in FIG. 6 situated near the entrance region 608 of the inflation device 604. In this regard, the actuator 638 may operate to move the pusher 616 from the entrance region 608, along a direction of the track toward the exit region 610. Inflatable protective packaging units may be received by the track 612 and positioned between the pusher 616 and the exit region 610. Accordingly, the second portion of the pusher 616 (received within the track 612) may engage one or more of the inflatable protective packaging units received with the track 612, thereby causing the inflatable protective packaging units to advance along a direction of the track 612 and toward the exit region 606.

The inflation device 604 may also include the filling station 650 that is used to discretely inflate inflatable protective packaging units supported by the track 612. It will be appreciated that while the filling station 650 is shown including various inflation components, actuators, support members, and so on, the embodiment shown in FIG. 6 is meant as illustrative. In other cases more or fewer components may be used to perform one or more functions of the filling station 650.

Broadly, the filling station may include the inflation component 658. The inflation component 658 may be a nozzle, coupling, or other structure that is configured to channel fluid to the inflatable protective packaging units supported by, for example, the track 612. In this regard, the inflation component 658 may be connected with a fluid source and be received by an inflatable protective packaging unit (e.g., at an inflation component receiver). FIG. 6 also shows a tube 660. The tube 660 may be fluidly coupled with the fluid source that is used to fill the inflatable protective packaging units.

The inflation component 658 is shown in FIG. 6 as being coupled with a first inflation component actuator 652. The first inflation component actuator 652 may be configured to move the inflation component 658 along a first axis, such as into and out of the track 612, and thus may define a component or be an inflation drive for the inflation component 658. As such the first inflation component actuator 652 may, in a first ("retracted") configuration, move the inflation component 658 away from the track 612, thereby allowing, for example, inflatable protective packaging units suspended within the track to pass below without being obstructed by the inflation component 658. In a second ("engaged") configuration, the first inflation component actuator 652 may move the inflation component 658 into the track 612. In a particular embodiment, the first inflation component actuator 652 may move the inflation component into the track 612 at a filling position, such as that corresponding to the location of a detent or other feature of the track 612 (e.g., detent 128 of FIG. 2B). An inflatable protective packaging unit may be positioned at the filling position. When the inflation component 658 moves into the track, the inflation component 658 may engage the inflatable protective packaging unit at the filling position. Once engaged, one or more systems of the inflation device may cause fluid to flow to the inflation component and subsequently into the various chambers of the inflatable protective packaging unit.

FIG. 6 also shows a second inflation component actuator 654. The second inflation component actuator 654 may broadly be configured to move the inflation component along a direction of the track 612, and thus may define a component or be an inflation drive for the inflation component 658. For example, the second inflation component actuator 654 may move the inflation component toward an exit region 606 of the inflation device 604. In some embodiments, the second inflation component actuator 654 may move the inflation component 658 toward the exit region 606 when the inflation component 658 is engaged with the inflation component receiver or other feature of the inflatable protective packaging unit. Accordingly, the second inflation component actuator 654 may cause the inflatable protective packaging unit to also move toward the exit region 606 of the inflation device 604.

At the exit region 606 of the inflation device 604, the inflatable protective packaging unit may be ejected. In some cases, the inflation device 604 may also operate to separate separable portions of the inflatable protective packaging unit at the exit region 606. For example, as described herein, the inflation device 604 may separate an inflation component receiver from flexible plies or other materials that define an inflatable portion of the inflatable protective packaging unit. To facilitate the foregoing, the inflation device 604 may include a separator 680 having a first ramp portion 682*a* and a second ramp portion 682*b*. The first and second ramp portions 682*a*, 682*b* may generally define a separation station along a portion of the track 612. For example, the first ramp portion 682*a* may be positioned along a first side of the track 612 (e.g., and coupled to the first wall portion 614*a*) and the second ramp portion 682*b* may be positioned along a second side of the track 612 (e.g., and coupled to the second wall portion 614*b*). The first and second ramps portions 682*a*, 682*b* can define diverging elements of the separator 680. As explained in greater detail below with respect to FIGS. 8A-8D, the separator may contact the flexible plies of the inflatable protective packaging unit as the inflation component receiver is advanced toward the exit region 606. As the inflation component receiver continues to move along a direction of the track 612, the separator may cause the flexible plies to move in another direction, away from the track 612, and thereby cause the flexible plies to sever from the track 612.

FIG. 7 depicts a cross-sectional view of the inflation system of FIG. 6, taken along line A-A of FIG. 1A. As shown in FIG. 7, the first wall portion 614*a* and the first track cover 618*a* cooperate to define a first recessed support 615*a*. Further, the second wall portion 614*b* and the second track cover 618*b* cooperate to define a second recessed support 615*b*. Each of the first recessed support 615*a* and the second recessed support 615*b* may be configured to receive a portion of an inflatable protective packaging unit and support the inflatable protective packaging unit along the track 612.

For example, for purposes of illustration, FIG. 7 shows an inflatable protective packaging unit 670. The inflatable protective packaging unit 670 has flexible plies 672 (defining inflatable chambers) and an inflation component receiver 675. The inflation component receiver 675 may be separably attached to the flexible plies, according to the embodiment herein. The inflation component receiver 676 may include a protrusion 676. The protrusion 676 extends from a body of the inflation component receiver 676 and into each of the first recessed support 615*a* and the second recessed support 615*b* in the embodiment of FIG. 7. As such, the inflatable protective packaging unit is substantially restrained from vertical and/or transverse movement when received within the track 612.

The inflation component receiver 675 may be configured to receive the inflation component 658. In this manner, the inflation component 658 may deliver fluid to the inflatable chambers defined by the flexible plies 672 using the inflation component receiver 675. Broadly, in accordance with various embodiments, the inflation component 658 may be any suitable nozzle, such as one used to deliver a fluid through the one-way check-valve. In one example, the nozzle may include a body that tapers toward the distal end. The tapered portion is located at the distal end of the nozzle body. In other embodiments, the nozzle body can be untapered, tapered along substantially its entire length, or have multiple tapered portions. The tapered portion of the nozzle body advantageously facilitates insertion of the inflation nozzle into an inflation port (e.g., opening 318 of FIG. 3) of the inflatable protective packaging unit 300. The inflation component 658 may be coupled with O-rings 662, shown in FIG. 7. The O-rings 662 may allow the inflation component 658 to form a seal with the inflation component receiver 675. The O-rings may also provide a flexible or resilient surface that allows the inflation component to be readily inserted and removed from the inflation component receiver 675.

The inflation component 658, shown in FIG. 7, may extend at least partially through the engagement member 620. For example, the inflation component 658 may extend through the elongated opening 622 and into the track 612. The engagement member 620 may also define a guide portion 621. The guide portion 621 may extend along the track 612 and be configured to receive a portion of the pusher 634. In particular, the guide portion 621 may define a path of travel of the pusher 634 along the track 612.

FIGS. 8A-8E depict an inflation device 804 according to various configurations. The inflation device 804 shown and described with respect to FIGS. 8A-8E is shown as a cross-section taken generally along a track of the inflation device 804 (e.g., track 812) and may be substantially analogous to the inflation device 104 shown and described with respect to FIGS. 1A-2B. For example, the inflation device 804 may be configured to receive a group of inflatable protective packaging units and discretely inflate each of the cushions at a filling station. Further, the inflation device 804 may be configured to separate portions of the inflatable protective packaging unit, such as separating an inflation component receiver (which may be substantially rigid) from flexible plies that form inflatable chambers of the cushion. In this regard, substantially analogous to the components described in relation to the embodiments described in relation to the embodiments of FIGS. 1A-2B, the inflation device 804 may broadly include: an inflation device 804, an entrance region 810, an exit region 805, a direction of a track 812, a pusher 834, an actuator 838, a first inflation component actuator 852, a second inflation component actuator 854, an inflation component 858, a group of inflatable protective packaging units 870, an inflation component receiver 875, flexible portion 872, and a separator 880, redundant explanation of which is omitted here for clarity.

Figure 8A:
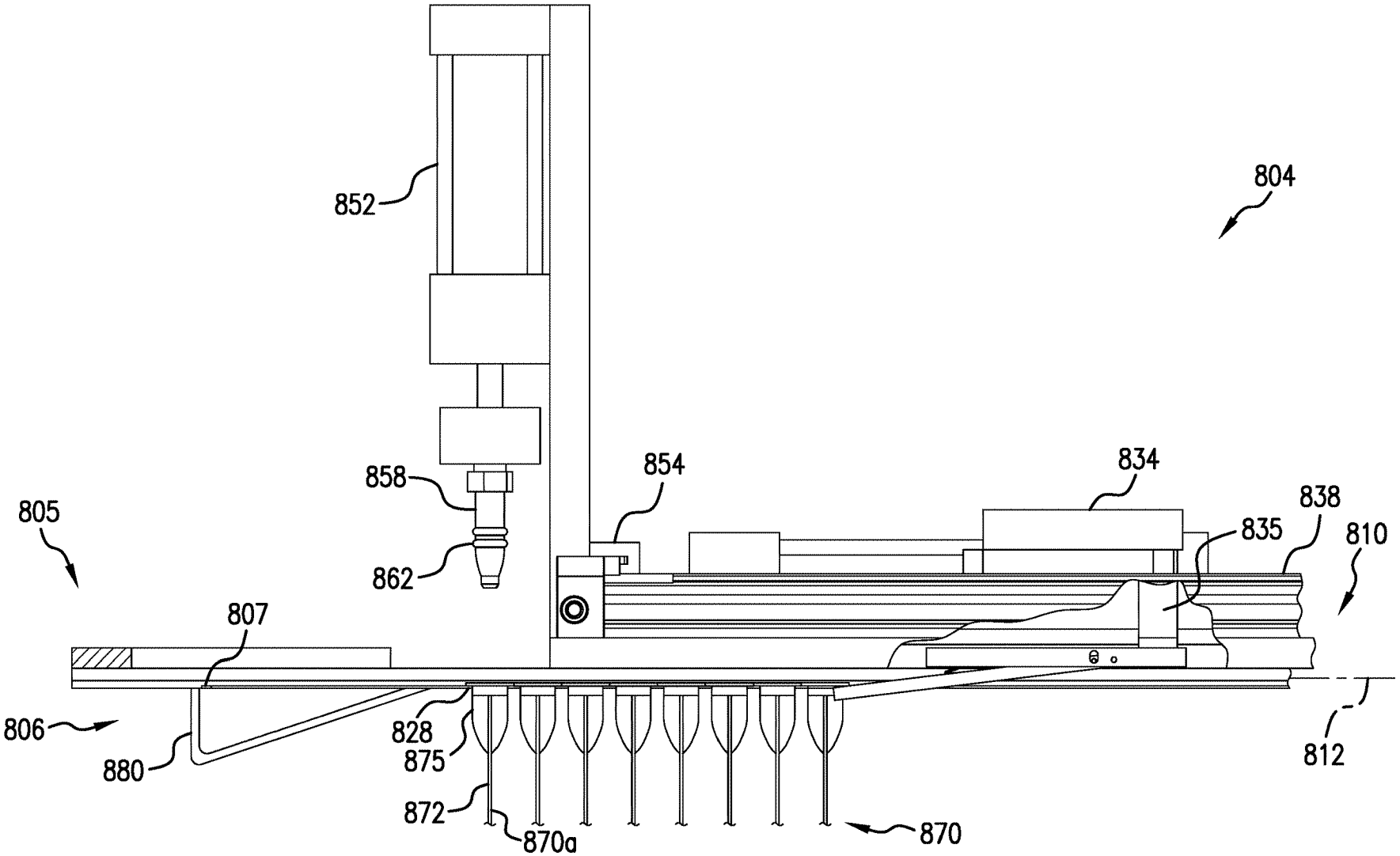
FIG. 8A depicts a side view of an inflation system in a first configuration.

With reference to FIG. 8A, in one configuration, a group of inflatable protective packaging units 870 are positioned along the track 812. The pusher 834 can be positioned near an entrance region 810 and extending into the track 812. The pusher 834 may include a tongue that engages one of the group of inflatable protective packaging units 870 supported by the inflation device 804. An actuator, such as the actuator 838, may cause the pusher 834 to move the group of inflatable protective packaging units 870 along the track 812 and toward an exit region 805. In so doing, the tongue (e.g., tongue 835), or other feature of the pusher 834, may cause the group of inflatable protective packaging units 870 to slide along the track 812. In some cases, the pusher 834 may cause the group of inflatable protective packaging units 870 to slide along the track 812 until one or the group of inflatable protective packaging units reaches a filling position. For example, a detent or other feature of the track may prevent movement of the group of inflatable protective packaging units 870 beyond a position where the inflation component may be used to provide fluid and subsequently inflate an inflatable protective packaging unit at the inflation position.

In the embodiment of FIG. 8A, an inflatable protective packaging unit 870*a* may be positioned at the filling position. For example, a detent 828 or other feature of the track 812 may temporarily prevent or cease movement of the inflatable protective packaging unit 870*a* beyond the position shown in FIG. 8A. In particular, the detent 828 or other feature may contact or otherwise engage the inflation component receiver 875, thereby causing the inflation component receiver to stop at the filling position. The inflation component receiver 875 may stop at the filling position, in some cases, despite biasing or force provided by the pusher 834 and couple actuator 838. At the filling position, the inflatable protective packaging unit 870*a* may be substantially aligned with the inflation component 858.

Figure 8B:
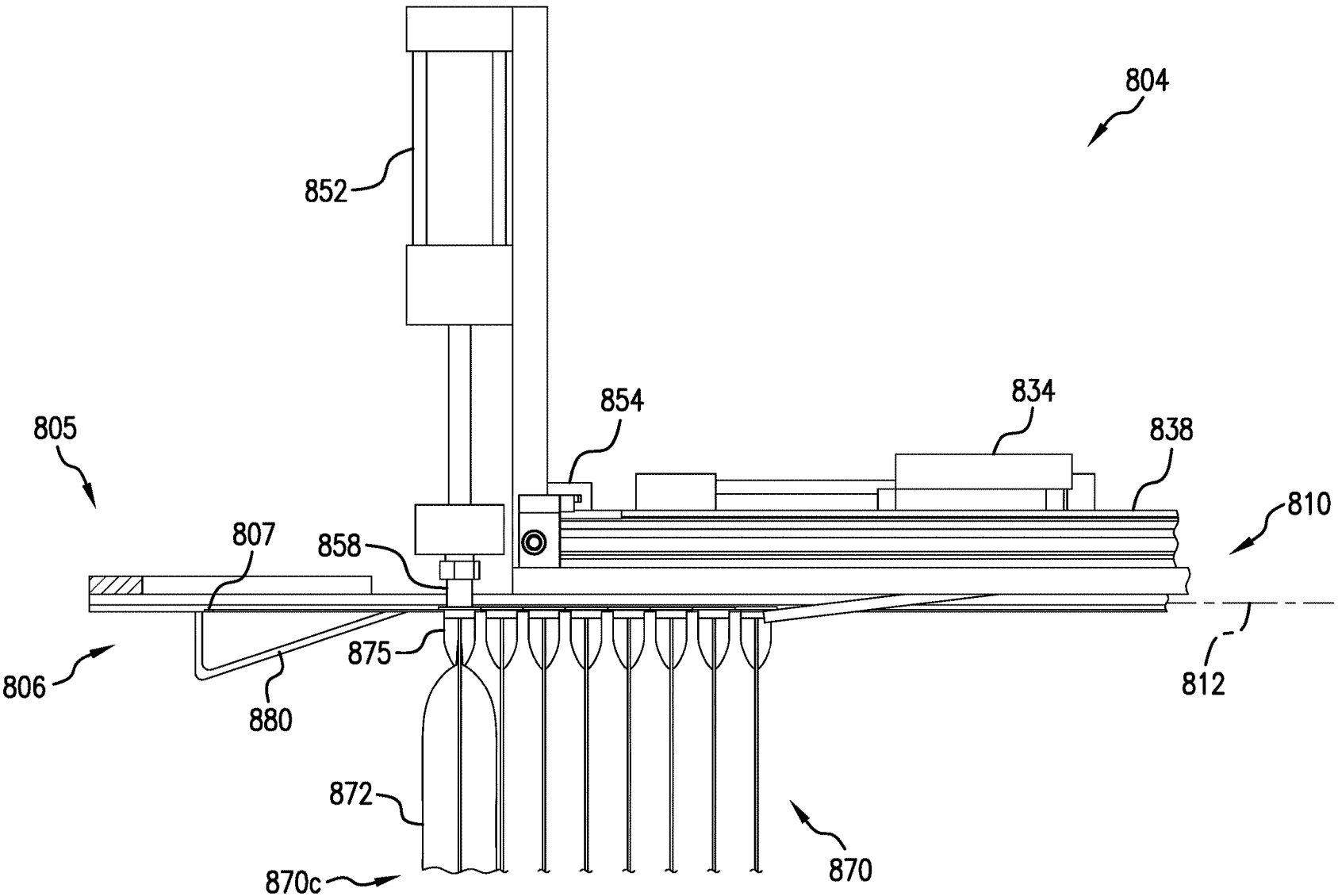
FIG. 8B depicts a side view of the inflation system in a second configuration.

With reference to FIG. 8B, another configuration is shown in which the inflatable protective packaging unit 870*c* is being inflated. In particular, FIG. 8B shows the first inflation component actuator 852 having moved the inflation component 858 at least partially into the track 812 and into the inflation component receiver 875. When the inflation component 858 is engaged with the inflation component receiver 875, fluid may flow into the inflatable chambers defined by the flexible plies 872. The flexible plies 872 are shown in FIG. 8B expanded from one another as the inflatable chamber begins to inflate.

Figure 8C:
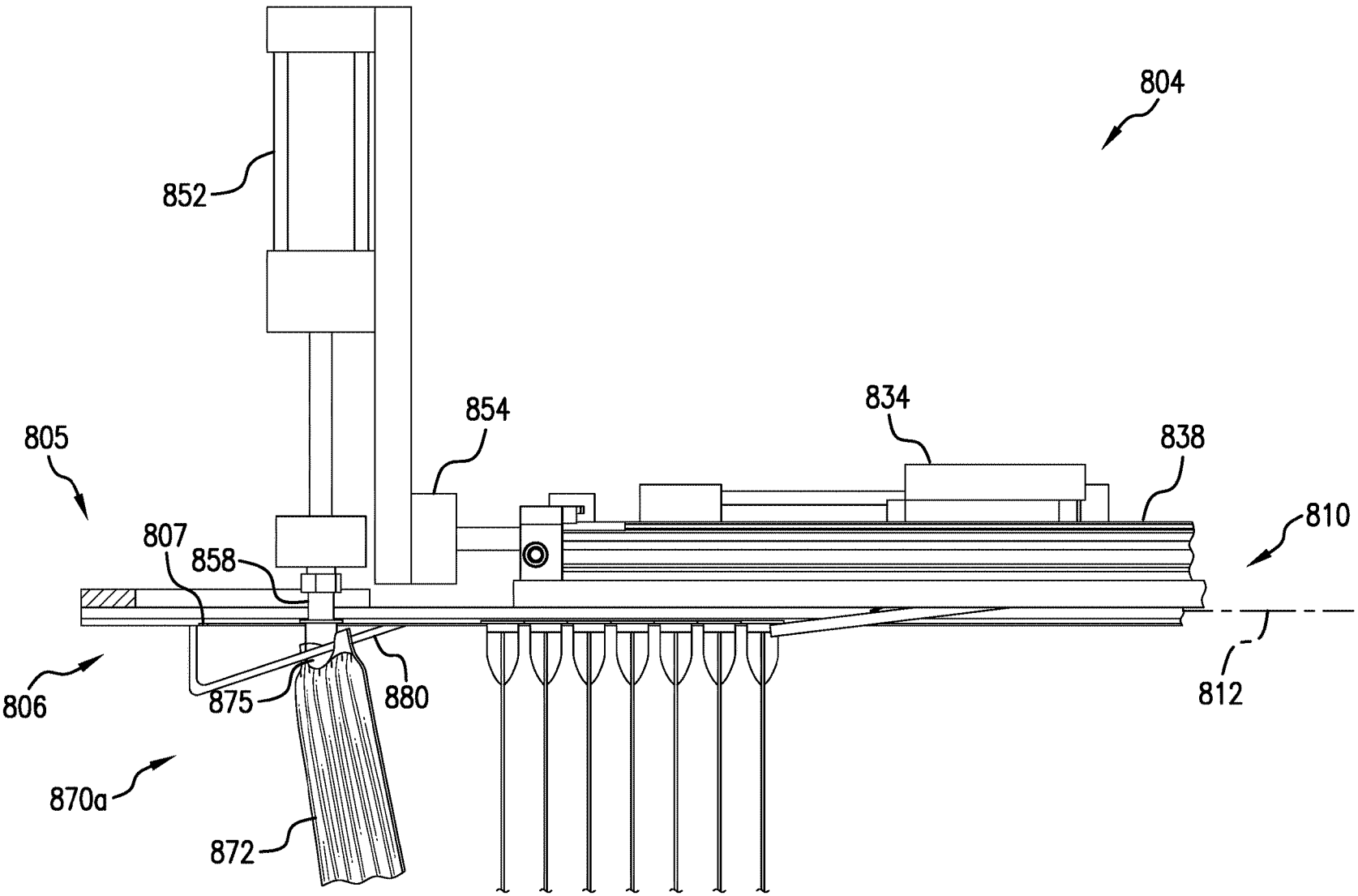
FIG. 8C depicts a side view of the inflation system in a third configuration.
Figure 10:
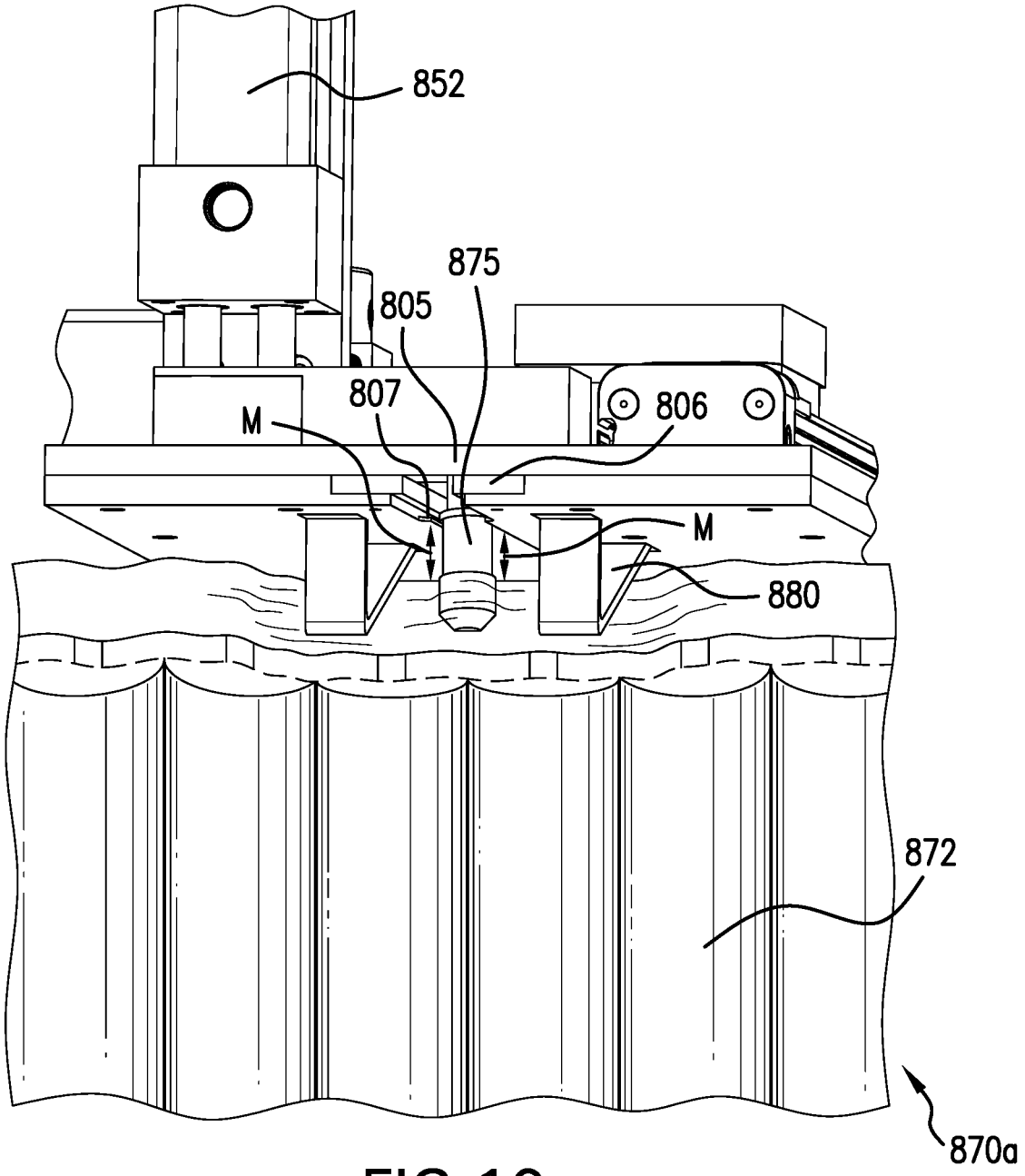
FIG. 10 depicts a detailed front view of the configuration of FIG. 8C.

With reference to FIGS. 8C and 10, another configuration is shown in which the inflatable protective packaging unit 870*a* is moved along a direction of the track 812 toward the exit region 805. In particular, FIG. 8C shows a rear side of the separator 880, which is causing the flexible plies 872 to detach from the inflation component receiver 875. Once separated, the inflated portion 872 may be ejected from the inflation device 804 as the inflation component receiver 875 continues to move along the track 812. Motion lines M shown in FIG. 10 illustrate the separation between the inflated portion 872 and the inflation component receiver 875.

To facilitate the foregoing, in the embodiment shown in FIGS. 8C and 10, the second inflation component actuator 854 may move the inflation component 858 along a direction of the track 812. The inflation component 858 may be engaged with the inflation component receiver 875 (e.g., due to the configuration described above with respect to FIG. 8B), and therefore the inflatable protective packaging unit 870*a* may move along a direction of the track 812 along with the inflation component 858. The separator 880 may contact, or otherwise prevent movement of, the flexible plies 872 of the inflatable protective packaging unit 870*a* as the inflation component receiver is caused to move along a direction of the track 812. This may cause the flexible plies 872 to initiate separation from the inflation component receiver 875, as shown in FIG. 8C.

In the embodiment of FIG. 8C, the separator may be defined by ramp portions. As such, as the inflation component receiver 875 is moved along a direction of the track 812, the flexible plies 872 are caused to move away from the track 812. As the flexible plies 872 move away from the track, the flexible plies 872 may separate from the inflation component receiver 875. Once separated, the flexible plies 872 may fall into a bin or other storage assembly for use in protective packaging, for example, such as when the flexible plies are entirely separated from the inflation component receiver 875, as shown in FIG. 8D.

Figure 8D:
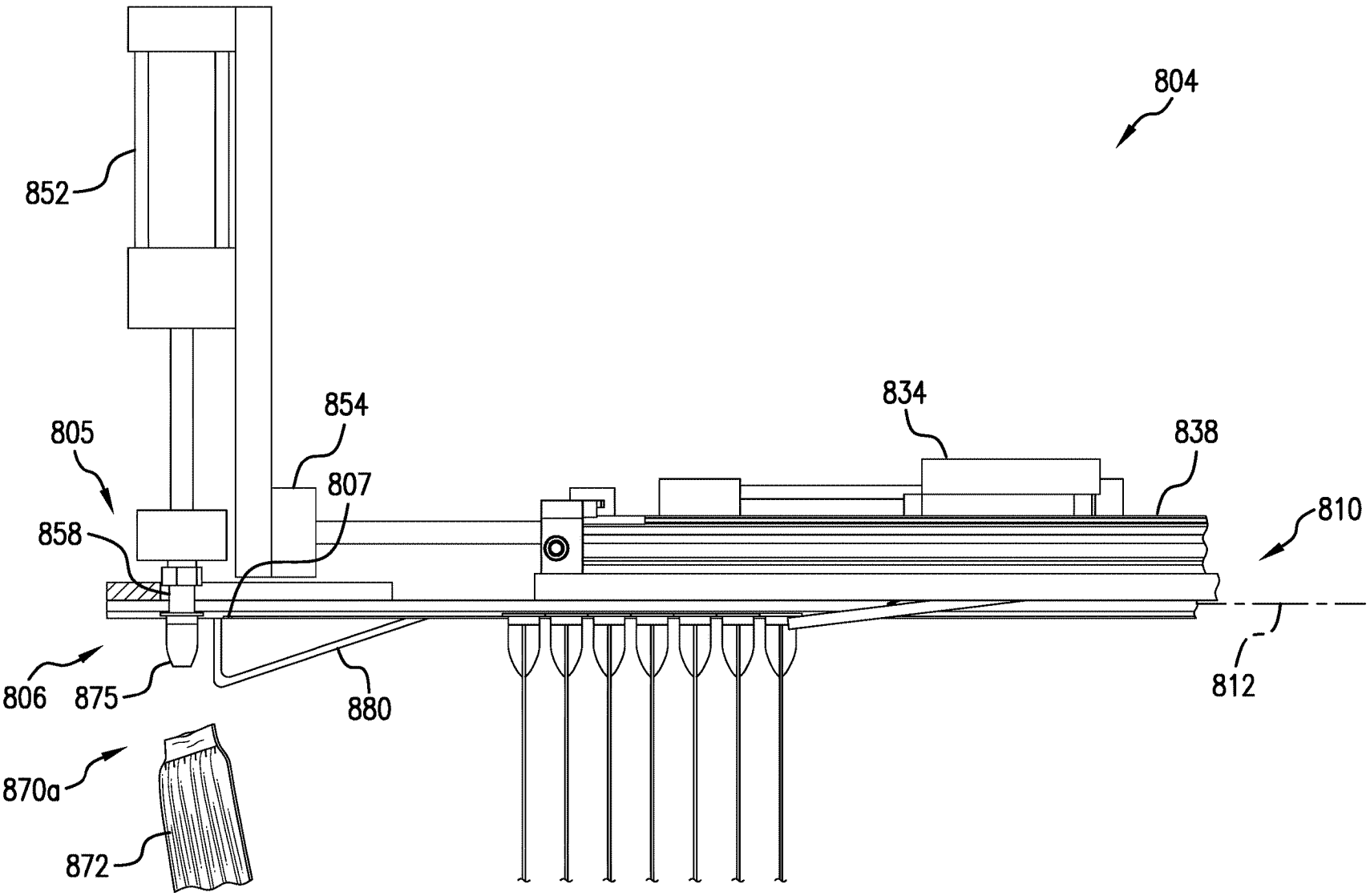
FIG. 8D depicts a side view of the inflation system in a fourth configuration.

With reference to FIG. 8D, in another configuration, the inflation component receiver 875 is advanced further along a direction of the track 812. For example, as shown in FIG. 8D, the inflation component receiver 875 is advanced along a direction of the track 812 and past the separator 880. As described above, as the inflation component receiver 875 is moved along the separator 880, the separator 880 causes the flexible plies 872 to move in a direction away from the inflation component receiver 875, thereby separating the flexible plies 872 from the inflation component receiver 875. The flexible plies 872 continue to move away from the inflation component receiver 875 until the flexible plies 872 are completely separated from the inflation component receiver 875. Once completely separated, the flexible plies 872 are no longer supported within the inflation device 804, and are thus ejected. The flexible plies 872 may fall into a receptacle, bin, and so on for subsequent use as protective packaging material.

Figure 11:
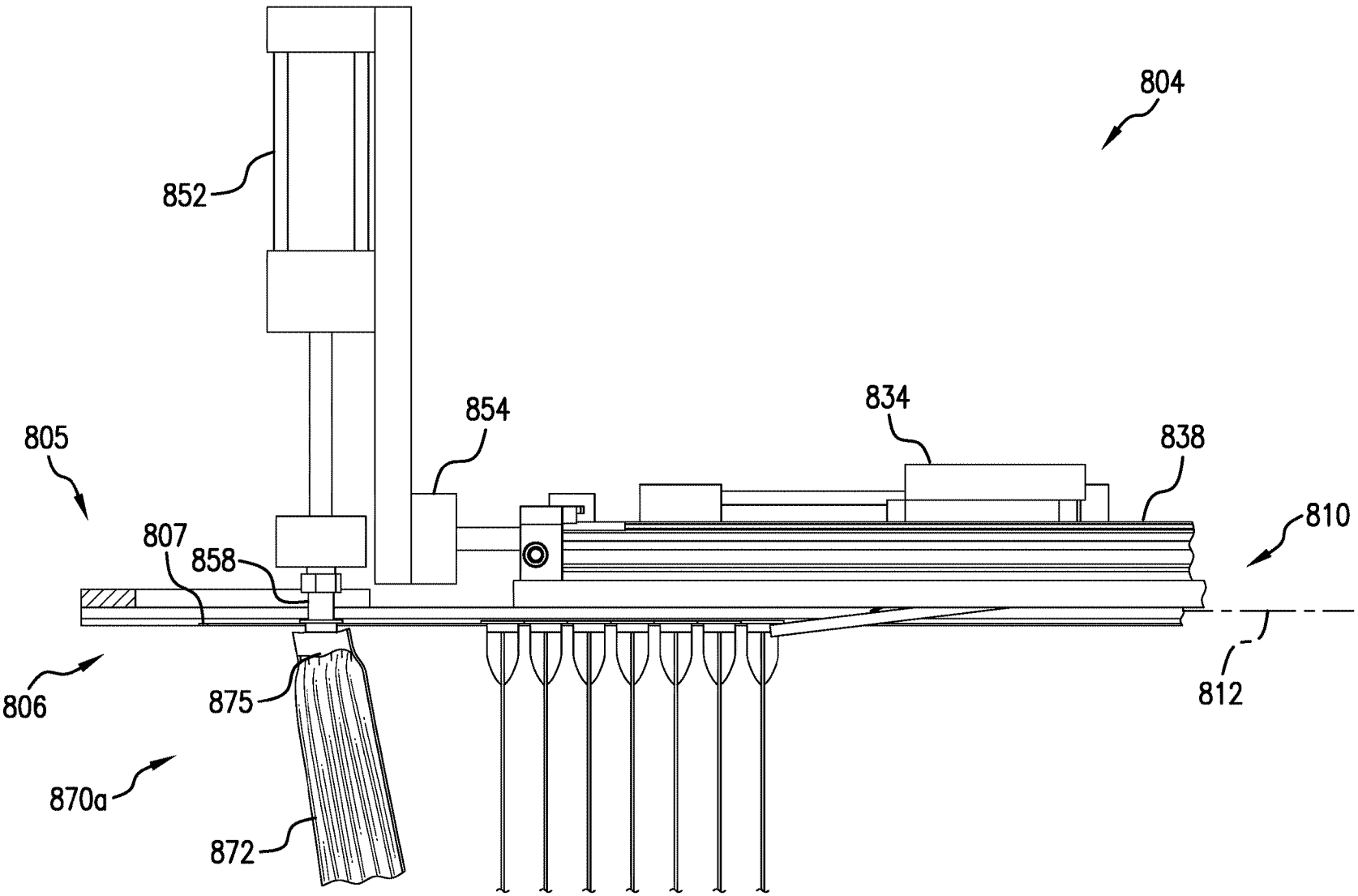
FIG. 11 depicts a side view of the inflation system without a separation element.

In accordance with some embodiments, as illustrated in FIG. 11, the track 812 does not include separator 880. For example, the inflation component receiver 875 is advanced along a direction of the track 812 until the release region 806 at which point the receiver 875 is removed from the inflation component 858. As the flexible packaging 872 travels along the track, a user can pull on the flexible packaging 872 separating the receiver 875 from the flexible packaging 872. In various examples, described herein, the removal of the receiver 875 is accomplished by the inflation component 858 being retracted away from the receiver 875, while the receiver 875 is held in place by the support 610. This action separates the engagement between the receiver 875 and the inflation component 858. In other examples, the receiver 875 may fall away under the force of gravity or is pulled from the nozzle by the force of the user. In some examples, the receiver 875 is non-removable from the flexible packaging 872 and as such, the entire flexible package leaves the track in the release region 806.

Figure 8E:
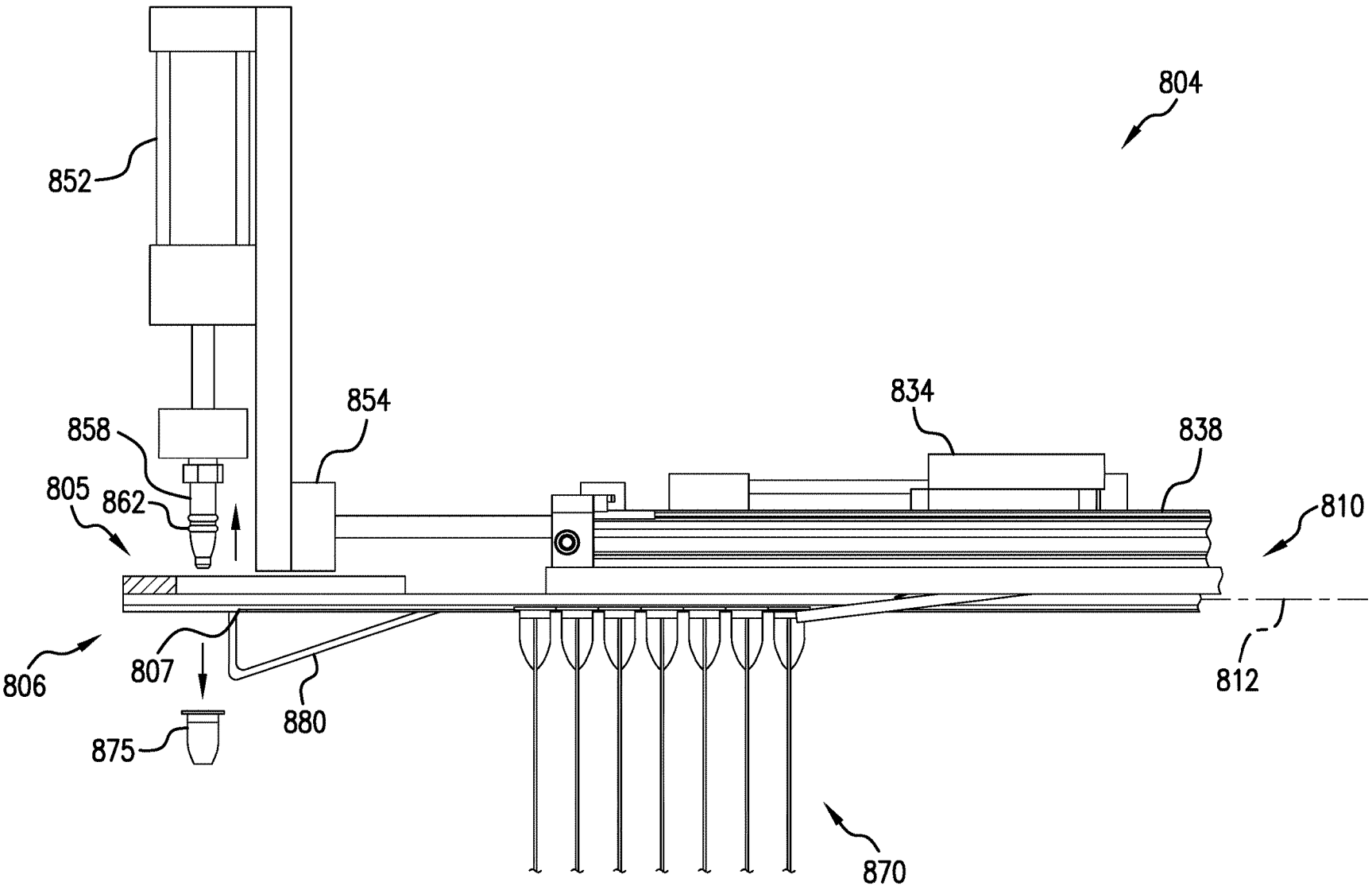
FIG. 8E depicts a side view of the inflation system in a fifth configuration.

With reference to FIG. 8E, in another configuration, the inflation component receiver 875 is subsequently ejected from or otherwise released by or from the inflation device 804. This configuration may occur subsequent to the separation of the flexible plies from the inflation component receiver; however, this is not required. In accordance with various embodiments, the exit region 105 includes a release portion 806 of the track 812. The release portion 806 of the track 812 includes any suitable mechanism for releasing the component receiver from the support thereof. For example, in embodiments in which a track 812 supports the inflation component receiver 875, the release portion 806 can be an enlarged width portion of the track 812. For example, the release portion 806 of the track 812 may have a width that is greater than a width of the inflation component receiver 875. As the inflation component receiver 875 is drawn along the track 812 and reaches a transition 807, whereat the width of the track 812 increases from W1 to W2 (see e.g. FIGS. 2A and 3) to define the release portion. As such, past the transition 807, the inflation component receiver 875 may no longer be supported by the track 812.

While no longer supported by the track 812, the inflation component receiver 875 may remain connected to the inflation component 858. For example, the inflation component 858 may include O-rings 862. The inflation component 875 and the O-rings 862 may establish a friction or interference fit that allows the inflation component 875 to be connected to inflation component 858, despite not being supported by the track 812 at the release portion 806.

In this manner, the inflation device 804 may use one or more actuators, such as the first inflation component actuator 852, to separate the inflation component receiver 875 and the inflation component 858. For example, as shown in FIG. 8E, the first inflation component actuator 852, may actuate in an upwards direction, and thus pull the inflation component 858 away from the inflation component receiver 875. The inflation component receiver 875 may be prevented from such upward motion, for example, by the track 812. As such, upon the inflation component 858 separating from the inflation component receiver 875, the inflation component receiver 875 may be ejected from the inflation device 804, such as being ejected in a downward direction shown in FIG. 8E. In some cases, the inflation device 804 may be arranged in order to have the inflation component receiver 875 fall into a different bin or other assembly component than that of the flexible plies. This may facilitate using the flexible plies (and inflated chambers) as protective packaging materials, while optionally reusing or recycling the inflation component receivers.

Figure 9:
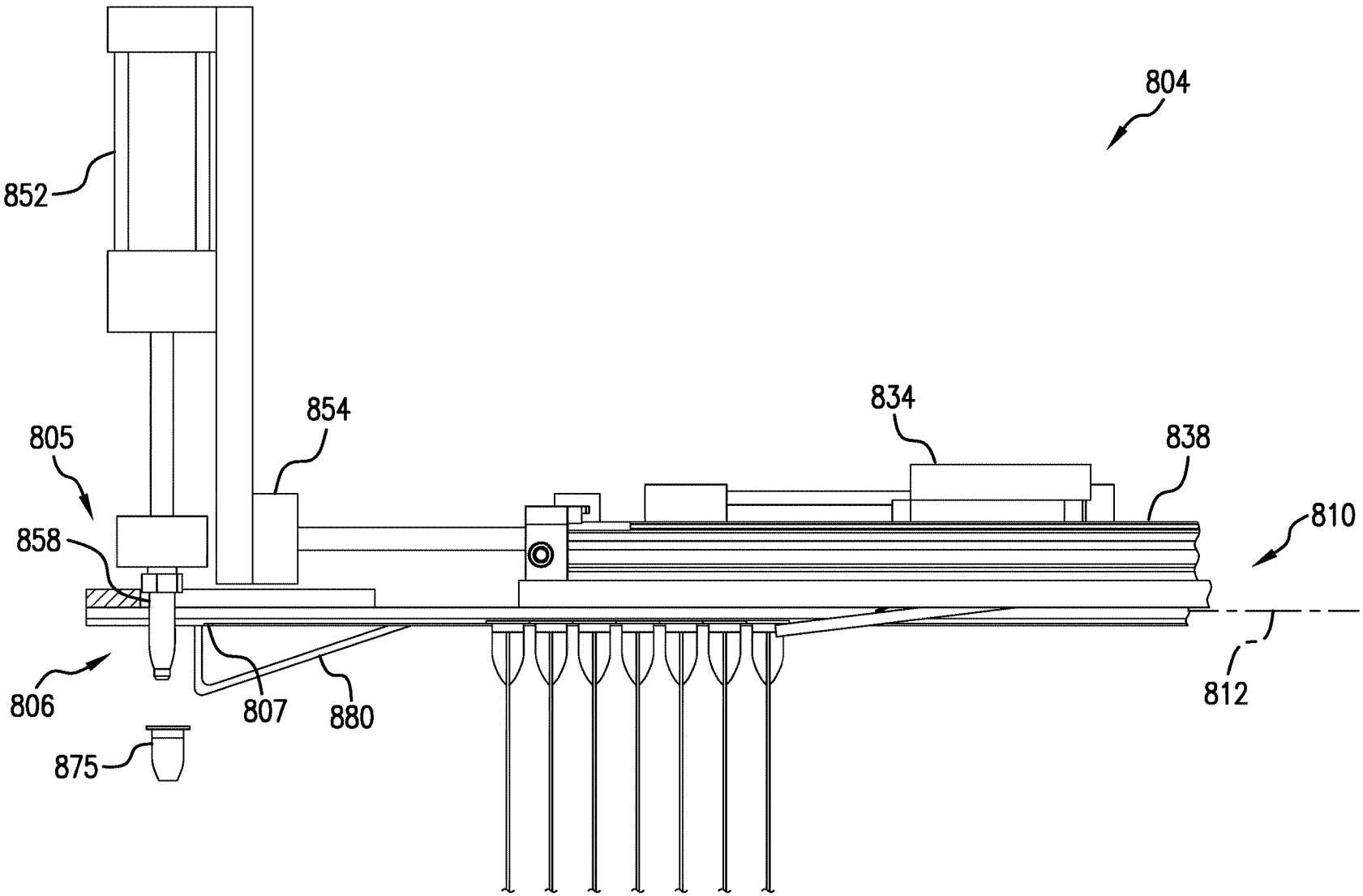
FIG. 9 depicts a side of another embodiment of the inflation system in the fifth configuration.

FIG. 9 depicts a configuration of the inflation device 804 in which the inflation component receiver 875 is ejected, according to another embodiment. As described above with respect to FIG. 8E, the inflation component receiver 875 may be connected to the inflation component 858 using O-rings. In the embodiment of FIG. 9, the inflation component 858 may be free of such O-rings. Accordingly, in the embodiment of FIG. 9, the inflation component receiver 875 may be loosely connected to the inflation component 858.

As described above, the inflation component receiver 875 may be advanced along the track 812, past the transition 807, and to the release region 806 of the track 812. At the release region 806, the track 812 has an enlarged width, and thus the inflation component receiver 875 is no longer supported within the inflation device 804 at the release region 806. And as described above, the inflation component receiver 875 is loosely connected to the inflation component 858 and/or otherwise connected in a manner such that the inflation component 858 may not necessarily support the weight of the inflation component receiver 875. As such, the inflation component receiver 875 may fall from the track 816 upon progression past the transition 807 and into the release region 806.

Like reference numerals designate like structural elements, however, the presence of different reference numerals is not necessarily indicative of different structural elements. In particular, like reference numerals in the last two digits of a reference number may be indicative of like elements. For example, the separator shown in FIGS. 1-2 labeled 180 are the same element as separator 680 in FIGS. 6-7 and separator 880 in FIGS. 8-10. A person of ordinary skill in the art will understand like structural elements as used in the various figures and embodiments based on the context and description of those elements discussed herein.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An inflatable protective packaging unit, comprising:

an inflatable component that includes overlaid flexible plies connected to each other to define a fluid chamber therebetween, the inflatable component defining an inflation region in fluid communication with the fluid chamber to allow fluid from the inflation region into the fluid chamber; and a receiver separably attached to the inflatable component at the inflation region and configured to direct fluid into the inflation region;

wherein:

the receiver comprises a body defining a channel therethrough that leads to the inflation region, the body being sufficiently rigid to suspend the flexible plies;

the inflation component receiver comprises a protrusion extending laterally with respect to the channel and configured to engage a track of an inflation device suitable to support the inflatable protective packaging unit therefrom.

2. The inflatable protective packaging unit of claim 1, wherein the receiver is disposed between the flexible plies.

3. The inflatable protective packaging unit of claim 2, wherein the receiver is separably attached to the inflatable component by a frangible connection.

4. The inflatable protective packaging unit of claim 3, wherein the frangible connection is defined by a spot weld between the receiver and one or more of the flexible plies.

5. The inflatable protective packaging unit of claim 1, wherein the inflatable component comprises a valve configured to allow one-way fluid flow from the inflatable component into the fluid chamber and the fluid chamber is configured to retain the fluid.

6. The inflatable protective packaging unit of claim 5, wherein the valve includes opposing flaps defining therebetween a collapsible fluid passage that opens in response to increased pressure in the inflation region to allow fluid flow into the fluid chamber, and collapses upon increased pressure in the fluid chamber to retain the fluid therein.

7. The inflatable protective packaging unit of claim 1, wherein the flexible plies define a group of fluid chambers in fluid communication with the inflation region, each of fluid chambers being fluidly isolated from one another.

8. The inflatable protective packaging unit of claim 1, wherein the receiver has a rigidity that is greater than a rigidity of the inflatable component.

9. The inflatable protective packaging unit of claim 1, wherein:

the receiver defines an exterior facing entry opening to receive the fluid, the receiver having sufficient rigidity to maintain open the entry opening; and the receiver is configured to receive an inflation component of an inflation device into the entry opening to thereby receive the fluid and direct the fluid into the inflation region.

10. The inflatable protective packaging unit of claim 1, wherein the receiver comprises a body defining a channel therethrough that leads to the inflation region and is separable from the inflation component upon pulling the inflatable component axially with respect to the channel of the receiver.

11. The inflatable protective packaging unit of claim 1, further comprising a frangible connection between the receiver and the inflation component that is sufficiently strong enough to suspend the flexible plies from the body.

12. The inflatable protective packaging unit of claim 1, wherein the protrusion extends radially about the channel of the receiver and is configured to be received in a gap between opposite side of the track and supported by the opposite sides of the track.

13. An inflation system, comprising:

the inflatable protective packaging unit of claim 1; and an inflatable protective packaging unit support magazine configured to receive the inflatable protective packaging unit and another inflatable protective packaging unit.

14. The inflation system of claim 13, further comprising an inflator that is guided into the receiver at a filling station and configured to deliver fluid into the receiver for filling the fluid chamber.

15. The inflation system of claim 14, further comprising an advancement mechanism configured to advance the inflatable protective packaging unit from a first position in the magazine to the filling station to a filling position where the inflator can engage the receiver.

16. The inflation system of claim 14, further comprising a separator disposed and configured to separate the receiver from the inflatable component after the inflatable component has been inflated with the fluid.

17. The inflation system of claim 16, wherein the separator is disposed at a separation station, the system further comprising an inflator drive that drives the inflator from the filling station to the separation station such that the inflator thereby moves the receiver to the separator to cause the separation of the receiver from the inflatable component.

18. The inflatable protective packaging unit of claim 1, wherein:

the receiver is disposed between the flexible plies; and air-permeable gaps are defined between the receiver and the flexible plies.

19. The inflatable protective packaging unit of claim 1, wherein the receiver is separably attached to the inflatable component by a friction fit.

20. An inflation system, comprising:

an inflatable protective packaging unit comprising:

an inflatable component that includes overlaid flexible plies connected to each other to define a fluid chamber therebetween, the inflatable component defining an inflation region in fluid communication with the fluid chamber to allow fluid from the inflation region into the fluid chamber; and a receiver attached to the inflatable component at the inflation region and configured to direct fluid into the inflation region; and a separator disposed and configured to separate the receiver from the inflatable component after the inflatable component has been inflated with the fluid;

wherein the separator moves the inflation component axially away from the receiver as the receiver is moved along a diverging element.

21. The inflation system of claim 20, wherein the receiver is separably attached to the inflatable component such that the receiver separable from the inflation region without inhibiting the ability of the fluid chamber to retain the fluid.

22. The inflation system of claim 20, further comprising an inflatable protective packaging unit support magazine configured to receive the inflatable protective packaging unit and another inflatable protective packaging unit.

23. The inflation system of claim 22, further comprising an inflator that is guided into the receiver at a filling station and configured to deliver fluid into the receiver for filling the fluid chamber.

24. The inflation system of claim 22, further comprising a separator disposed and configured to separate the receiver from the inflatable component after the inflatable component has been inflated with the fluid.

* * * * *